US005254451A

United States Patent [19]

Kita et al.

[11] Patent Number: 5,254,451

[45] Date of Patent: Oct. 19, 1993

[54] SILVER HALIDE COLOR PHOTOGRAPHIC LIGHT SENSITIVE MATERIAL

[75] Inventors: Hiroshi Kita; Yutaka Kaneko; Noboru Mizukura; Toru Kubota, all of Tokyo, Japan

[73] Assignee: Konica Corporation, Tokyo, Japan

[21] Appl. No.: 927,409

[22] PCT Filed: Mar. 2, 1992

[86] PCT No.: PCT/JP92/00243

§ 371 Date: Sep. 22, 1992

§ 102(e) Date: Sep. 22, 1992

[30] Foreign Application Priority Data

Feb. 13, 1992 [JP] Japan ..... 4-26816

[51] Int. Cl.[5] ..... G03C 7/38

[52] U.S. Cl. ..... 430/558; 430/386; 430/387

[58] Field of Search ..... 430/558, 386, 387

[56] References Cited

U.S. PATENT DOCUMENTS 5,001,041 3/1991 Kishimoto et al. ..... 430/558

FOREIGN PATENT DOCUMENTS 1159647 7/1986 Japan ..... 430/558
62-25757 2/1987 Japan .
0166647 3/1989 Japan .
2-296241 12/1990 Japan ..... 430/558
0315842 1/1991 Japan .
3-126031 5/1991 Japan .
3-156453 7/1991 Japan .
0416842 1/1992 Japan .

OTHER PUBLICATIONS

J 04/067142-Abstract Mar. 3, 1992.

*Primary Examiner*—Lee C. Wright
*Attorney, Agent, or Firm*—Jordan B. Bierman

[57] ABSTRACT

A silver halide color photographic light sensitive material comprising a magenta represented by Formula I-3 or I-4 is disclosed.

Formula I-3

Formula I-4

$R_1$, $R_2$ and $R_4$ represent each a substituent;

X represents a hydrogen atom or a group capable of splitting off;

Y represents a group consisting of non-metal atoms necessary to form a 5- or 6-membered heterocyclic ring;

m is 1 or 2; and n is 0 to 4.

The invention provides a silver halide color photographic light sensitive material having exellent color reproducibility and color producibility, in which material stability against light of magenta dye image is remarbly improved.

3 Claims, No Drawings

SILVER HALIDE COLOR PHOTOGRAPHIC LIGHT SENSITIVE MATERIAL

FIELD OF THE INVENTION

This invention relates to a silver halide color photographic light sensitive material containing a magenta coupler and, particularly, to a silver halide color photographic light sensitive material in which a color reproducibility and color producibility can be excellent and a dye image stable against heat and light can be obtained when containing a novel pyrazoloazole type magenta coupler therein.

BACKGROUND OF THE INVENTION

As for the couplers generally applicable to silver halide color photographic light sensitive materials, there have been known couplers including, for example, the yellow couplers each comprising a open-chained ketomethylene type compound, the magenta couplers each comprising a pyrazolone or pyrazoloazole type compound and the cyan couplers each comprising a phenol or naphthol type compound. Among them, a 5-pyrazolone compound has very often been used for the magenta couplers so far.

The known pyrazolone magenta couplers are described in, for example, U.S. Pat. Nos. 2,600,788 and 3,519,429 and Japanese Patent Publication Open to Public Inspection (hereinafter referred to as JP OPI Publication) Nos. 49-111631(1974) and 57-35858(1982). However, the dyes made of the pyrazolone magenta couplers have produced an undesirable side-absorption which has been demanded for the improvements, as described in 'The Theory of the Photographic Process', the 4th Ed., Macmillan Publishing Co., 1977, pp.356–358; 'Fine Chemical', Vol. 14, No.8, CMC Press, pp.38–41; and the Lecture Transcription published at the 1985 Annual convention of the Society of Photographic Science of Japan, pp.108–110.

As described in the above-given literatures, the dyes made of the pyrazoloazole type magenta couplers do not produce any side-absorption. The above-given literatures, U.S. Pat. Nos. 3,725,067, 3,758,309 and 3,810,761 and so forth describe that the couplers of this type are excellent.

However, the light-fastness of azomethine dyes made of the couplers are so seriously low that the characteristics of color photographic light sensitive materials, particularly those of print type color photographic light sensitive materials are seriously spoiled.

The studies and researches have been tried for improving the light-fastness. For example, JP OPI Publication Nos. 59- 125732(1984), 61-282845(1986), 61-292639(1986) and 61-279855(1986) disclose the techniques of making combination use of a pyrazoloazole type coupler and a phenol type compound or a phenylether compound and JP OPI Publication Nos. 61-72246(1986), 62-208048(1987), 62-157031(1987) and 63-163351(1988) disclose the techniques of making combination use of a pyrazoloazole type coupler and an amine type compound.

Further, JP OPI Publication No. 63-24256(1988) proposes for a pyrazoloazole type magenta coupler having an alkyloxyphenyloxy group.

In the above-given techniques, the light-fastness of magenta dye images are still unsatisfactory and the improvements thereof have been eagerly demanded.

SUMMARY OF THE INVENTION

This invention has been made for solving the above-mentioned problems. It is, therefore, an object of the invention is to provide a silver halide color photographic light sensitive material excellent in color reproducibility and color developability and remarkably improved in light-fastness of magenta dye images.

The above-mentioned object of the invention can be achieved with (1) a silver halide color photographic light sensitive material containing a magenta coupler represented by the following Formula I.

Formula I

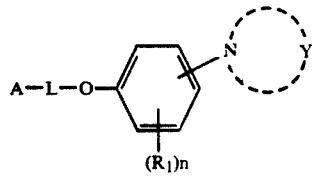

wherein A represents a residual group eliminating $R_2$ or $R_3$ from a pyrazolotriazole magenta coupler represented by the following Formula II or III; L represents a divalent linking group; Y represents a group consisting of the non-metal atoms necessary to form a 5- or 6-membered heterocyclic ring together with a nitrogen atom; $R_1$; represents a substituent; and n is an integer of 0 to 4.

Formula II

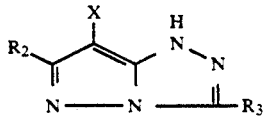

Formula III

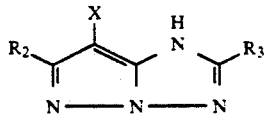

wherein $R_2$ and $R_3$ represent each a hydrogen atom or a substituent; and X represents a hydrogen atom or a group capable of splitting off upon reaction with the oxidized product of a color developing agent.

The desirable silver halide color photographic light sensitive materials are those denoted by (1) above in which the magenta coupler represented by the above-given Formula I is further represented by the following Formula I-1 or I-2.

Formula I-1

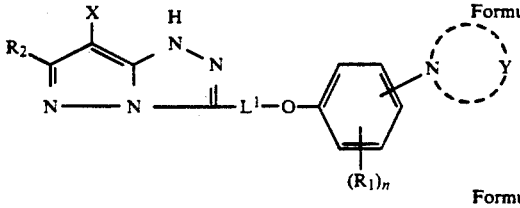

Formula I-2

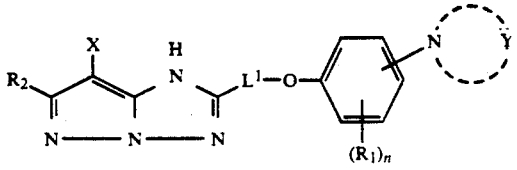

wherein $L^1$ represents a divalent linking group having a principal chain length of not more than 5 atoms; $R_1$ and $R_2$ represent each a substituent; Y represents a group consisting of non-metal atoms necessary to form a 5- or 6-membered heterocyclic ring together with a nitrogen atom; n is an integer of 0 to 4; and X represents a hydrogen atom or a group capable of splitting off upon reaction with the oxidized product of a color developing agent.

The preferable silver halide color photographic light sensitive materials are those denoted by (1) above in which the magenta coupler represented by the above-given Formula I is further represented by the following Formula I-3 or I-4.

Formula I-3

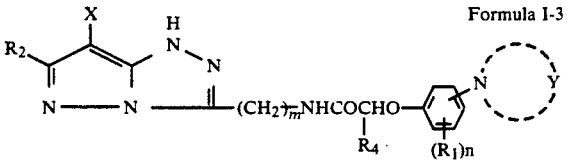

Formula I-4

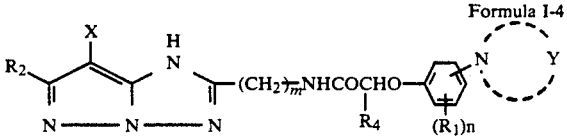

wherein $R_1$, $R_2$ and $R_4$ represent each a substituent; Y represents a group consisting of non-metal atoms necessary to form a 5- or 6-membered heterocyclic ring together with a nitrogen atom; n is an integer of 0 to 4; m is an integer of 1 or 2; and X represents a hydrogen atom or a group capable of splitting off upon reaction with the oxidized product of a color developing agent.

The invention is described concretely

In the above-given Formulas I, II, III, I-1, I-2, I-3 and I-4,

There is no special limitation to the substituents represented by $R_1$, $R_2$, $R_3$ and $R_4$. The substituents include, typically, each group of alkyl, aryl, anilino, acylamino, sulfonamido, alkylthio, arylthio, alkenyl or cycloalkyl. In addition to the above, they further include, for example, a halogen atom or each group of cycloalkenyl, alkinyl, heterocyclic, sulfonyl, sulfinyl, phosphonyl, acyl, carbamoyl, sulfamoyl, cyano, alkoxy, aryloxy, heterocyclic-oxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl or heterocyclic-thio and, besides, a spiro compound residual group or an organic hydrocarbon compound residual group.

The alkyl groups represented by $R_1$, $R_2$, $R_3$ and $R_4$ include, desirably, those having 1 to 32 carbon atoms and they may be straight-chained or branched.

As for the aryl groups represented by $R_1$, $R_2$, $R_3$ and $R_4$, phenyl groups are preferred The acylamino groups represented by $R_1$, $R_2$, $R_3$ and $R_4$ include, for example, an alkylcarbonylamino group or an arylcarbonylamino group.

The sulfonamido groups represented by $R_1$, $R_2$, $R_3$ and $R_4$ include, for example, an alkylsulfonylamino group and an arylsulfonylamino group.

The alkyl components and the aryl components in the alkylthio and the arylthio groups each represented by $R_1$, $R_2$, $R_3$ and $R_4$ include, for example, the alkyl or aryl groups each represented by the above-denoted $R_1$, $R_2$, $R_3$ and $R_4$.

The alkenyl groups represented by $R_1$, $R_2$, $R_3$ and $R_4$ include, preferably, those having 2 to 32 carbon atoms. The cycloalkyl groups represented thereby include, desirably, those having 3 to 12 carbon atoms and, preferably, those having 5 to 7 carbon atoms. The alkenyl groups may be straight-chained or branched.

The cycloalkenyl groups represented by $R_1$, $R_2$, $R_3$ and $R_4$ include, desirably, those having 3 to 12 carbon atoms and, preferably, those having 5 to 7 carbon atoms.

The sulfonyl groups represented by $R_1$, $R_2$, $R_3$ and $R_4$ include, for example, an alkylsulfonyl group and an arylsulfonyl group;

The sulfinyl groups represented thereby include, for example, an alkylsulfinyl group and an arylsulfinyl group;

The phosphonyl groups represented thereby include, for example, an alkylphosphonyl group, an alkoxyphosphonyl group, an aryloxyphosphonyl group and an arylphosphonyl group;

The acyl groups represented thereby include, for example, an alkylcarbonyl group and an arylcarbonyl group;

The carbamoyl groups represented thereby include, for example, an alkylcarbamoyl group and an arylcarbamoyl group;

The sulfamoyl groups represented thereby include, for example, an alkylsulfamoyl group and an arylsulfamoyl group;

The acyloxy groups represented thereby include, for example, an alkylcarbonyloxy group and an arylcarbonyloxy group;

The carbamoyloxy groups represented thereby include, for example, an alkylcarbamoyloxy group and an arylcarbamoyloxy group;

The ureido groups represented thereby include, for example, an alkylureido group and an arylureido group;

The sulfamoylamino groups represented thereby include, for example, an alkylsulfamoylamino group and an arylsulfamoylamino group;

The heterocyclic groups represented thereby include, desirably, those having 5- to 7-members and, typically, a 2-furyl, group, a 2-thienyl group, a 2-pyrimidinyl group and a 2-benzothiazolyl group;

The heterocyclic-oxy groups represented thereby include, desirably, those having a 5- to 7-membered heterocyclic ring and, for example, a 3,4,5,6-tetrahydropyranyl-2-oxy group and a 1-phenyltetrazole-5-oxy group;

The heterocyclic-thio groups represented thereby include, desirably, those having 5- to 7-members and, for example, a 2-pyridylthio group, a 2-benzothiazolylthio group and a 2,4-diphenoxy-1,3,5-triazole-6-thio group;

The siloxy groups represented thereby include, for example, a trimethylsiloxy group, a triethylsiloxy group and a dimethylbutylsiloxy group;

The imido groups represented thereby include, for example, a succinimido group, a 3-heptadecyl succinimido group, a phthalimido group and a glutarimido group;

The spiro compound residual groups represented thereby include, for example, a spiro[3.3]heptane-1-yl; and The organic hydrocarbon compound residual groups represented thereby include, for example, a bicyclo[2.2.1]heptane-1-yl [3.3.1.1$^{37}$]decane-1-yl and 7,7-dimethyl-bicyclo[2.2.1]heptane-1-yl.

Each of the groups represented by $R_1$, $R_2$, $R_3$ and $R_4$ include those each further having a substituent.

The groups capable of splitting off upon reaction with the oxidized product of a color developing agent, which are represented by X, include, for example, a halogen atom (such as a chlorine atom, a bromine atom and a fluorine atom) and each of the groups of alkoxy, aryloxy, heterocyclic-oxy, acyloxy, sulfonyloxy, alkoxycarbonyloxy, aryloxycarbonyl, alkyloxalyloxy, alkoxyoxalyloxy, alkylthio, arylthio, heterocyclic-thio, alkyloxythiocarbonylthio, acylamino, sulfonamido, nitrogen-containing heterocyclic ring bonded with an N atom, alkyloxycarbonylamino and aryloxycarbonylamino. Among them, halogen atoms including, particularly, a chlorine atom are preferable.

When n is not less than 2, a plurality of $R_1$ may be the same with or the different from each other and they are also allowed to form a condensed ring in this case.

The invention also includes polymer couplers such as a dimer coupler containing a pyrazolotriazole ring in $R_2$, $R_3$ or X.

The invention further includes the compounds each having a group eliminating A from the compounds represented by the foregoing Formula I in the residual groups represented by A denoted in Formula I.

In the foregoing Formula I, the divalent linking groups represented by L or $L_1$ include, for example, a divalent group or those formed by combining the above-mentioned divalent groups, each derived from each of the following groups, namely, the groups of alkyl, aryl, anilino, acylamino, sulfonamido, alkylthio, arylthio, alkenyl cycloalkyl, cycloalkenyl, alkinyl, heterocyclic, sulfonyl, sulfinyl, phosphonyl, acyl, carbamoyl, sulfamoyl, alkoxy, aryloxy, heterocyclic-oxy, acyloxy, carbamoyloxy, amino, alkylamino, imido, ureido, sulfamoylamino, alkoxycarbonylamino, aryloxycarbonylamino, alkoxycarbonyl, aryloxycarbonyl and heterocyclic-thio; and they may preferably be represented by the following Formula X.

$$\text{—}(R_{13})_p\text{—}(L_1)_q\text{—}(R_{14})_r\text{—}(L_2)_s\text{—}(R_{15})_t\text{—}(L_3)_u \qquad \text{Formula X}$$

wherein $R_{13}$ side is bonded to a pyrazoloazole ring.

In Formula X, $R_{13}$, $R_{14}$ and $R_{15}$ represent independently an alkylene, arylene, alkylenearylene or aralkylene group each having 1 to 12 carbon atoms. The alkylene groups may be straight-chained or branched and they include, for example, a methylene group, a methylmethylene group, a dimethylene group and a decamethylene group. The arylene groups include, for example, a phenylene group, and a naphthylene group. The aralkylene groups and alkylenearylene groups include, for example, the following groups,

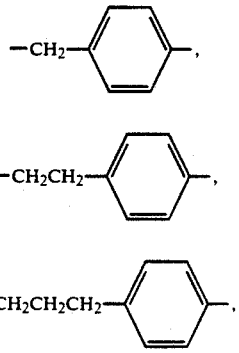

-continued

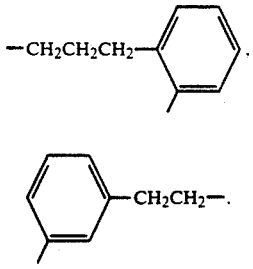

The alkylene, arylene, alkylenearylene or aralkylene group represented by $R_{13}$, $R_{14}$ and $R_{15}$ are each allowed to have a substituent. The substituents include, for example, those represented by the foregoing $R_1$, $R_2$, $R_3$ and $R_4$.

In Formula X, $L_1$, $L_2$ and $L_3$ represent each the following compound.

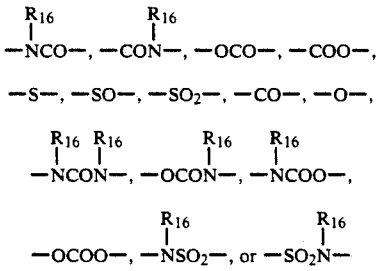

wherein $R_{16}$ represents a hydrogen atom, an alkyl group or an aryl group, provided, when two $R_{16}$s are made present, each of them may be the same with or the different from each other; and p, q, r, s, t and u are each an integer of 0 or 1.

In the foregoing Formulas I, I-1, I-2, I-3 and I-4, the group consisting of non-metal atoms represented by Y are each preferable to contain the following compound.

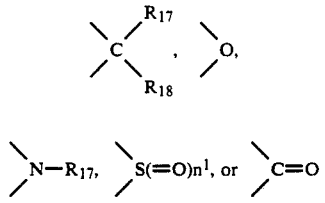

wherein $R_{17}$ and $R_{18}$ represent independently a hydrogen atom, an alkyl group or an aryl group; and $n^1$ is an integer of 0 to 2.

In the foregoing Formula I, the 5- or 6-membered heterocyclic rings represented by

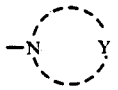

may be saturated or unsaturated. However, they are preferable to be saturated. These heterocyclic rings are each allowed to have a substituent represented by $R_1$, $R_2$, $R_3$ or $R_4$.

In Formulas I-1 and I-2, $L^1$ represents a divalent linking group having not more than 5 atoms in the principal chain length thereof; provided, when a ring structured portion is made present in the linking group, the numbers of the atoms are to be counted along the interatomic distance wherein the smallest numbers of the atoms are counted. For example, 3 atoms in m-phenylene and 2 atoms in o-phenylene.

The linking groups represented by $L^1$ have the following Formula $X_1$.

$$*_1\text{-}A_1\text{-}A_2\text{-}A_3\text{-}A_4\text{-}A_5\text{-}*_2 \qquad \text{Formula } X_1$$

wherein $A_1$ through $A_5$ represent each an atom capable of having not less than 2 valencies or a simple linking hand, provided, each of the atoms may also be each substituted with a hydrogen atom or a substituent; $*_1$ represents a position where the linking group is linked to a pyrazolotriazole ring; and $*_2$ represents a position wherein the linking group is linked to a phenoxy group.

The atoms capable of having not less than 2 valencies, which are represented by $A_1$ through $A_5$, are the atoms belonging to the groups $II_A$, $III_A$, $IV_A$, $V_A$ and $VI_A$ of the periodic Table. They are, desirably, non-metal atoms, more desirably, carbon, nitrogen, oxygen, silicon, phosphorus, sulfur and selenium and, preferably, carbon, nitrogen, oxygen, sulfur and phosphorus.

The preferably examples of $L^1$ will be given below. $L^1$ shall not, however, be limited thereto.

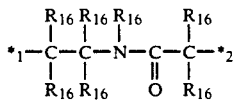

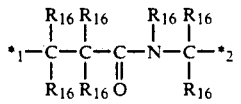

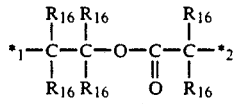

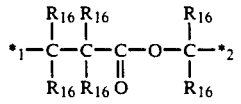

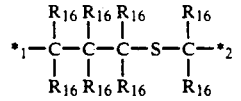

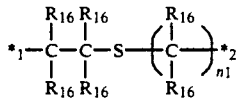

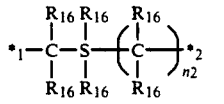

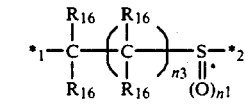

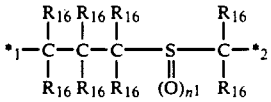

-continued

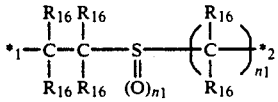

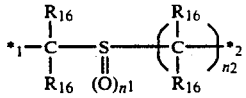

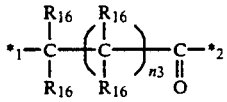

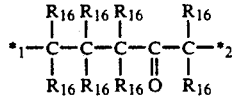

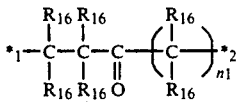

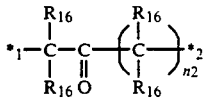

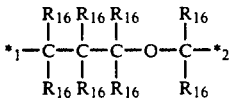

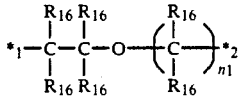

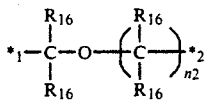

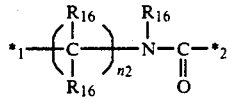

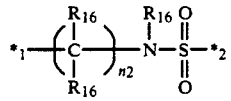

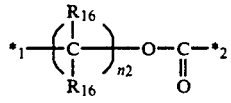

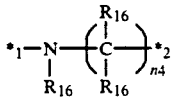

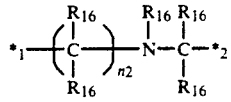

-continued
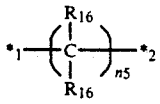
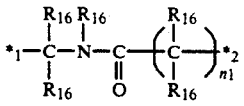
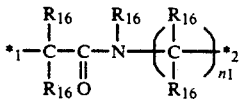
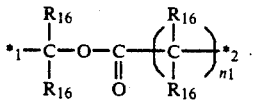
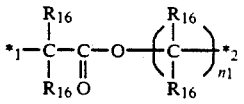
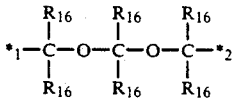
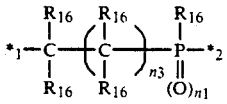
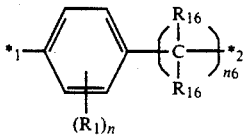
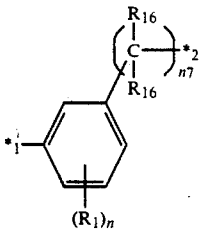
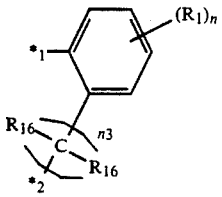
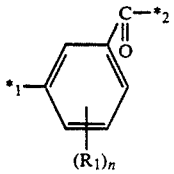
-continued
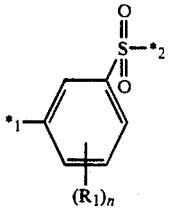
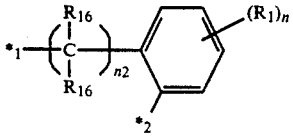
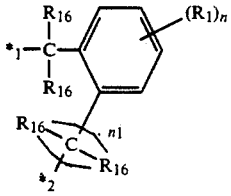
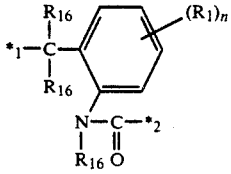
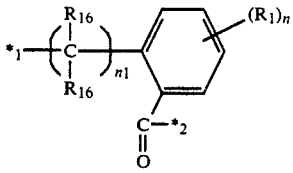
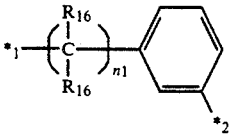
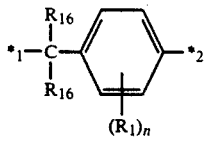
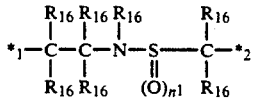
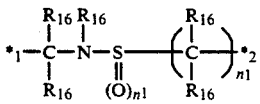
wherein $R_{16}$, $R_1$, $*_1$, $*_2$ and $n^1$ are each the same as aforenoted; $n_1$ is an integer of 1 or 2; $n_2$ is an integer of 2 or 3; $n_3$ is an integer of 0, 1, 2, or 3; $n_4$ is an integer of 1 to 4; $n_5$ is an integer of 1 to 5; $n_6$ is an integer of 0 or 1; and $n_7$ is an integer of 0, 1 or 2.

The typical examples of the magenta couplers relating to the invention will be given below. However, the invention shall not be limited thereto.
MA-1
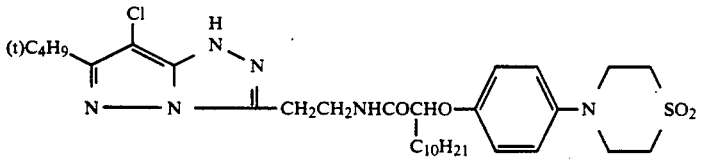
MA-2
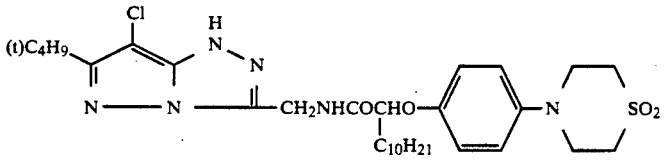
MA-3
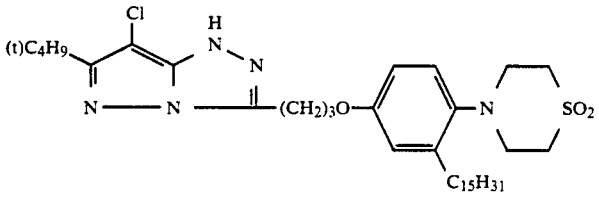
MA-4
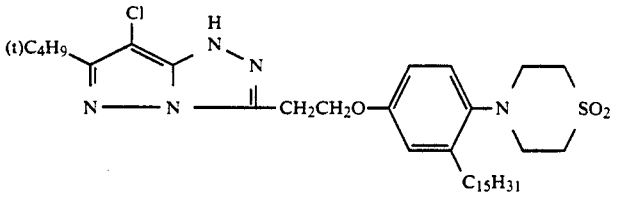
MA-5
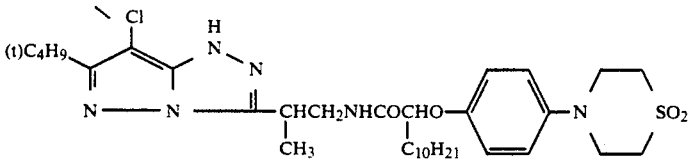
MA-6
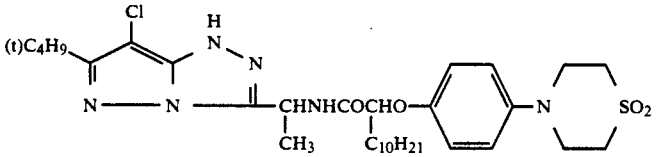
MA-13
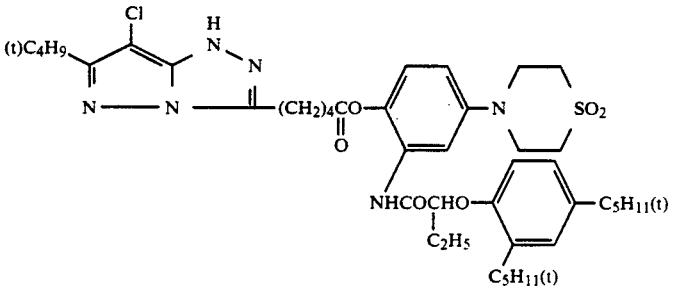

-continued
MA-14
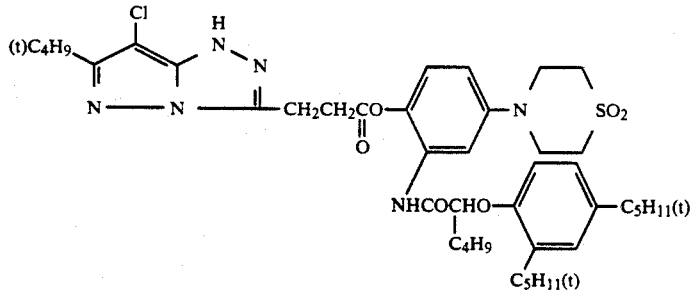
MA-15
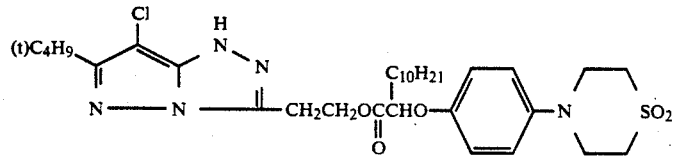
MA-16
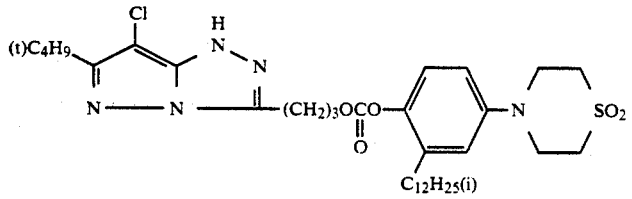
MA-17
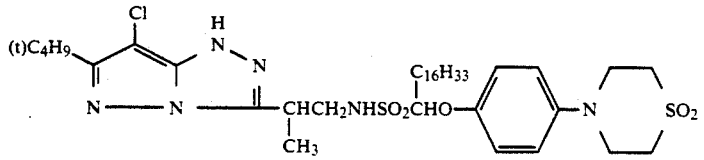
MA-18
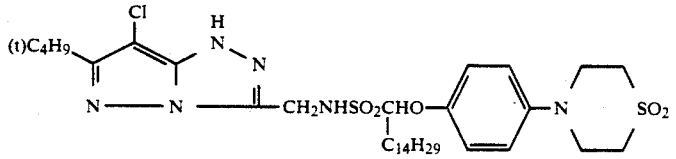
MA-7
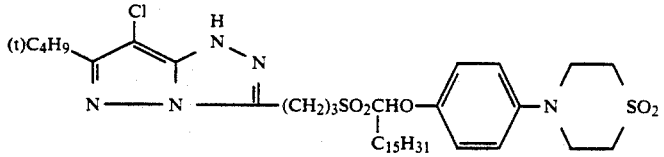
MA-8
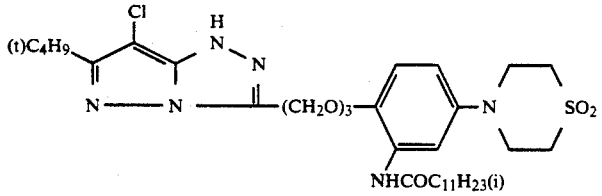
MA-9
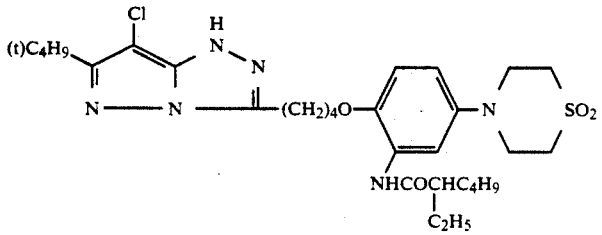

-continued
MA-10
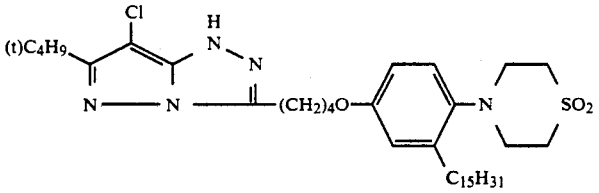
MA-11
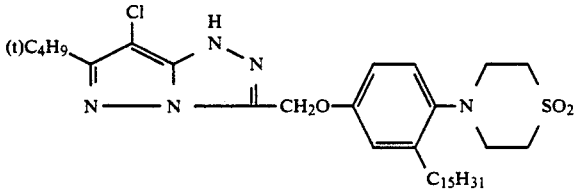
MA-12
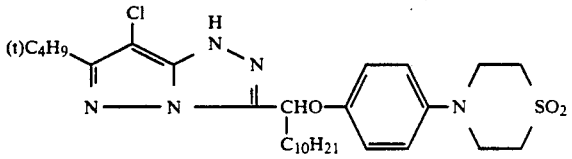
MA-25
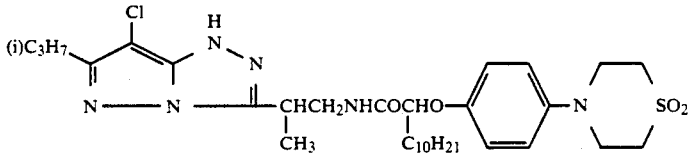
MA-26
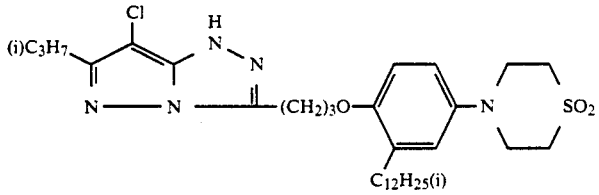
MA-27
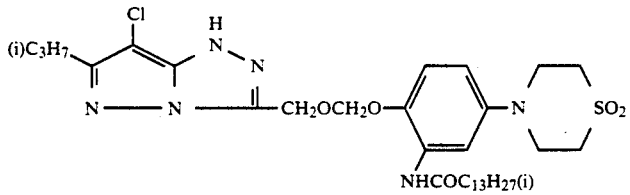
MA-28
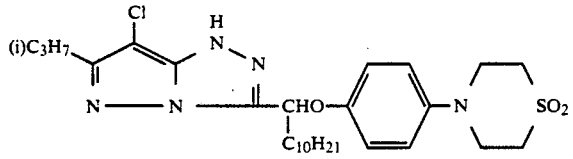
MA-29
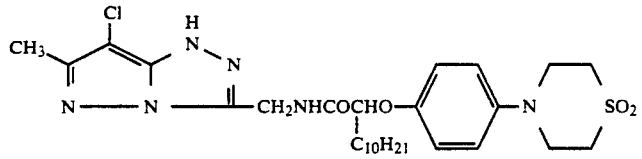
MA-30
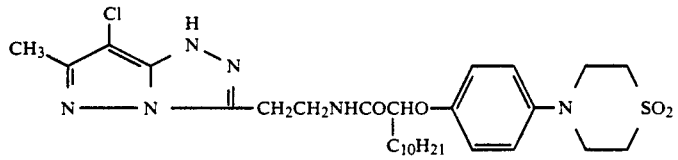

-continued
MA-31
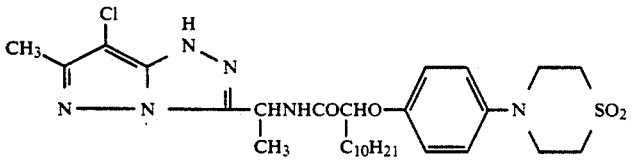
MA-32
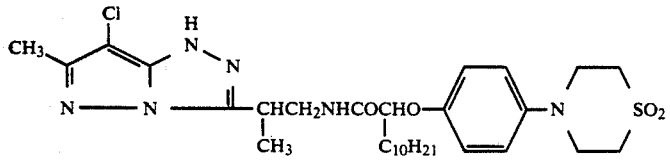
MA-33
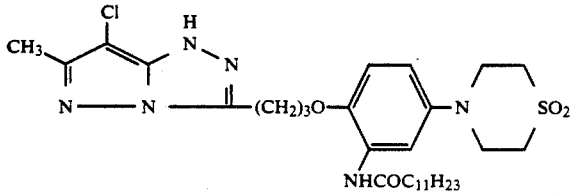
MA-34
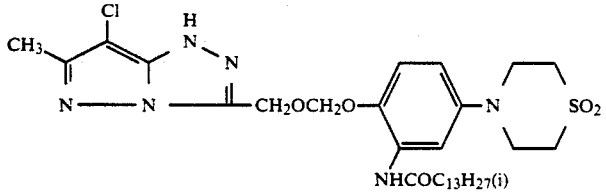
MA-35
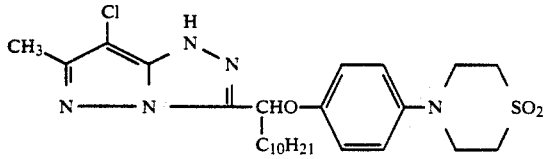
MA-36
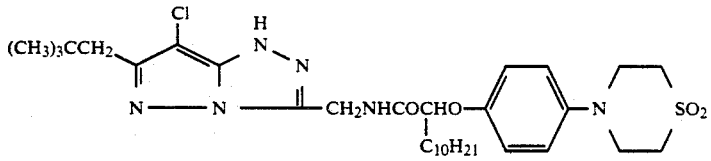
MA-37
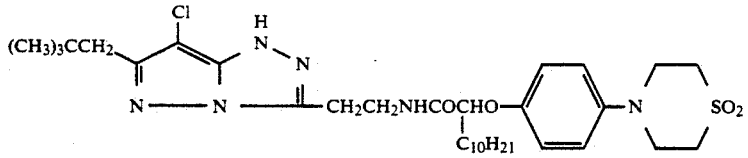
MA-38
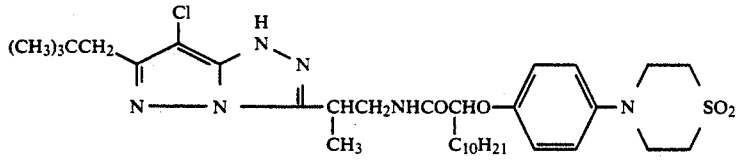
MA-39
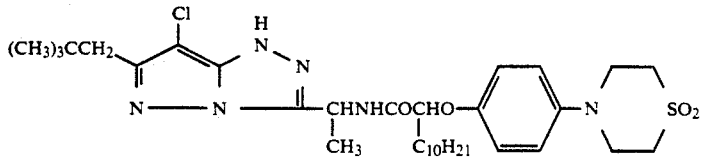

-continued
MA-40
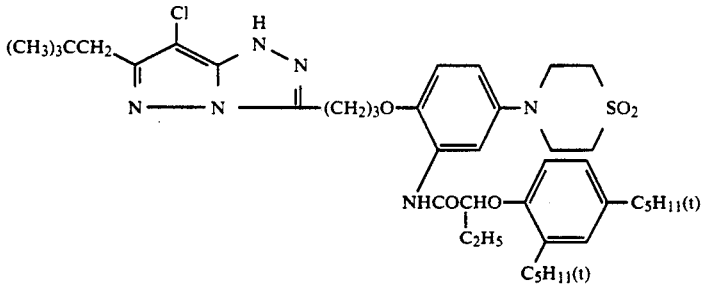
MA-41
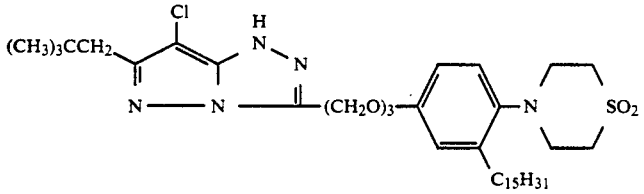
MA-42
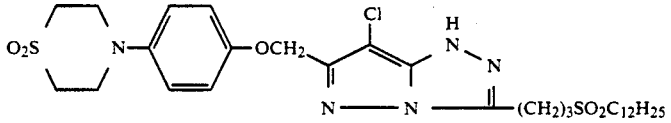
MA-43
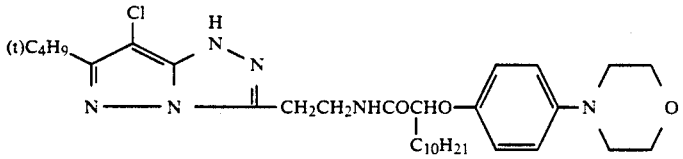
MA-44
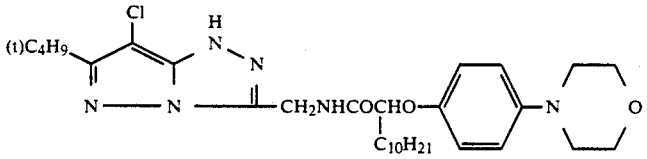
MA-45
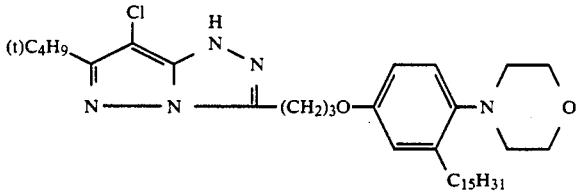
MA-46
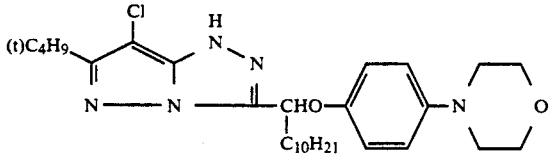
MA-47
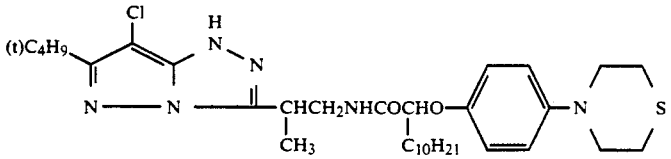

-continued
MA-48
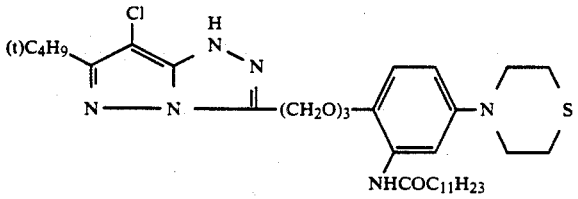
MA-49
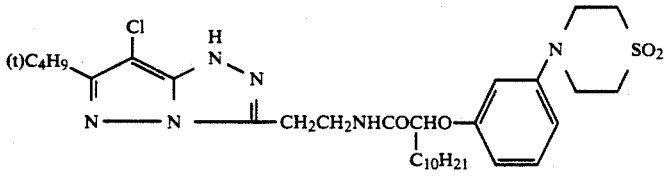
MA-50
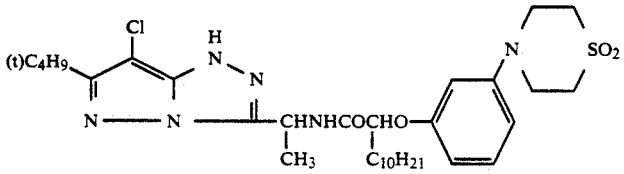
MA-51
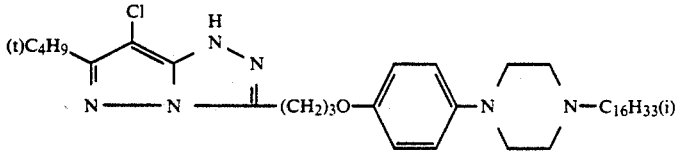
MA-52
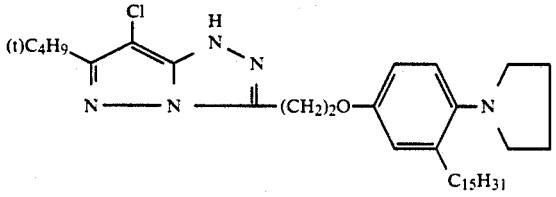
MA-53
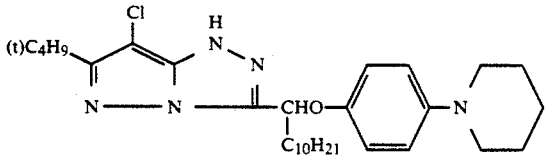
MA-54
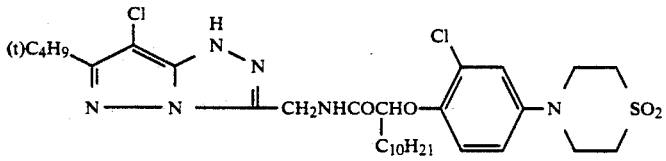
MA-55
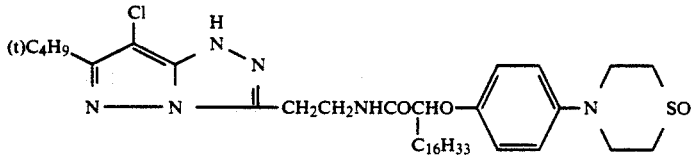
MA-56
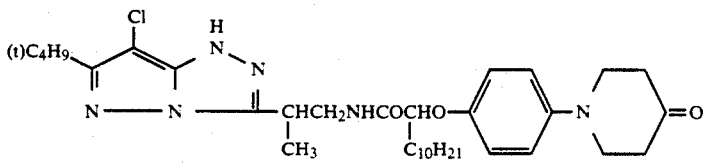

-continued
MA-57
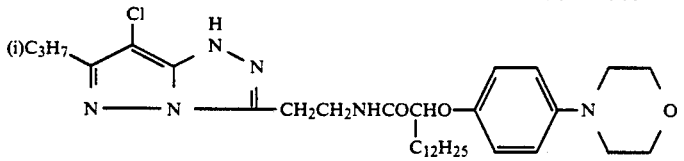
MA-58
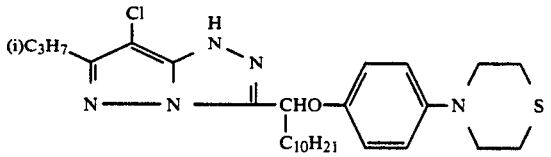
MA-59
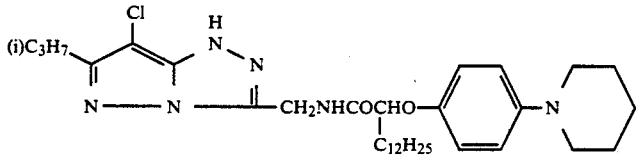
MA-60
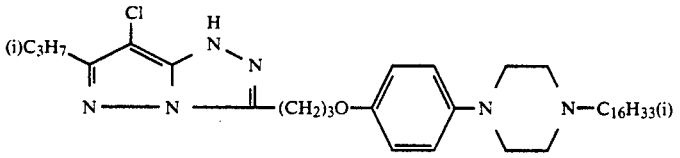
MA-61
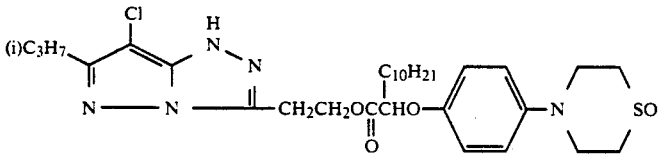
MA-62
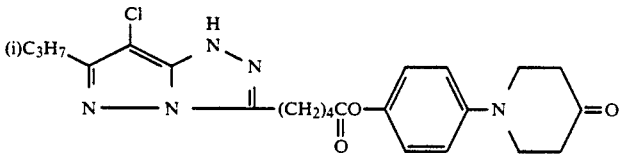
MA-63
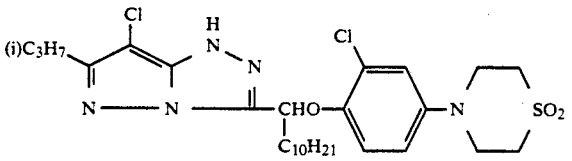
MA-64
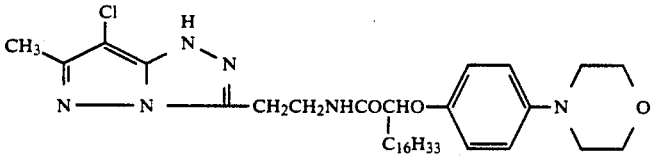
MA-65
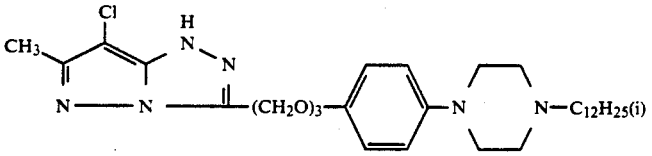
MA-66
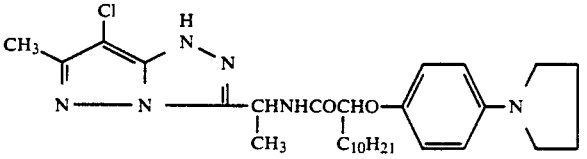

-continued
MA-67
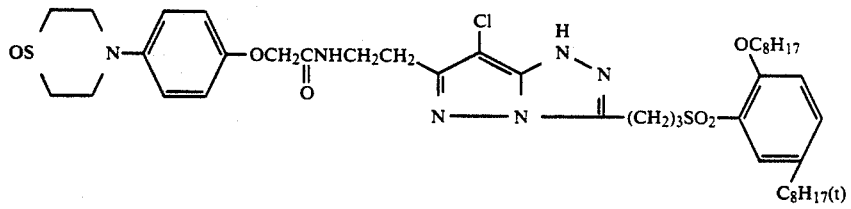
MA-68
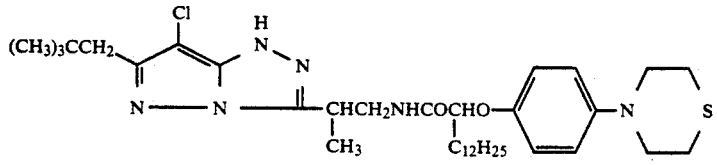
MA-69
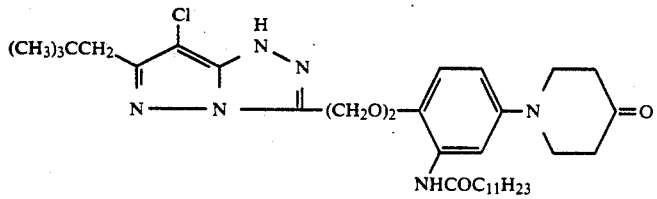
MA-70
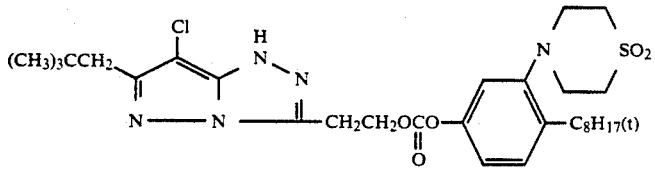
MA-71
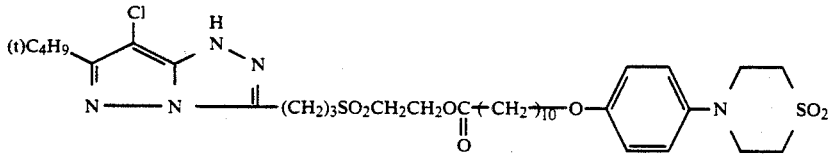
MA-72
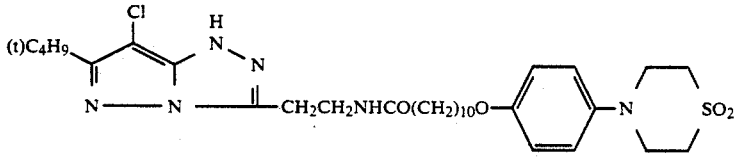
MA-73
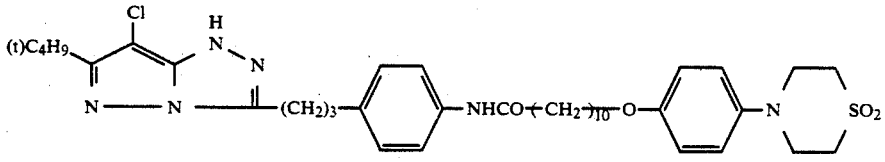
MA-74
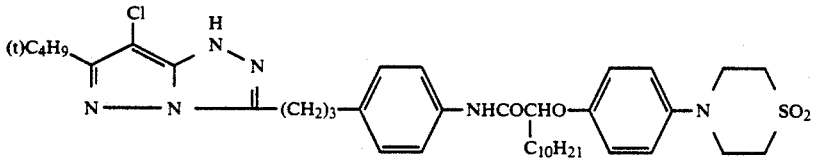
MA-75
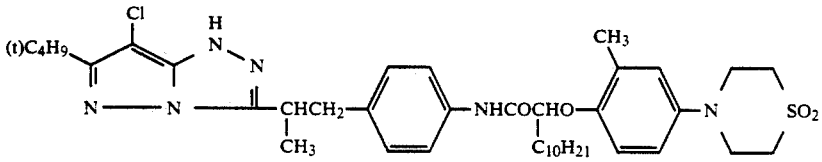

-continued
MA-76
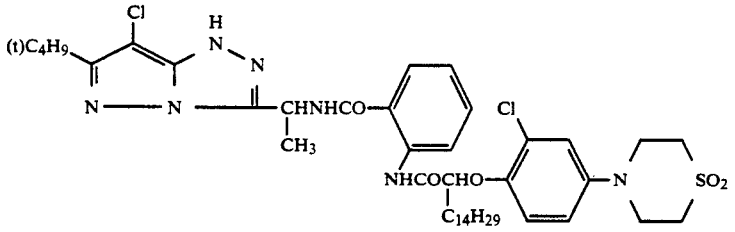
MA-77
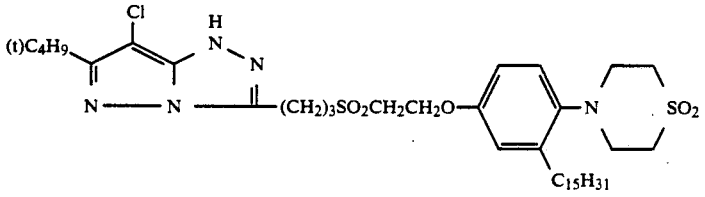
MA-78
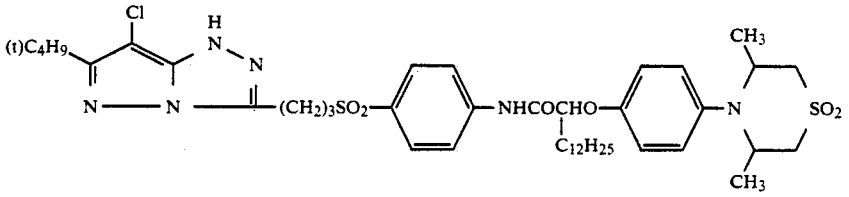
MA-79
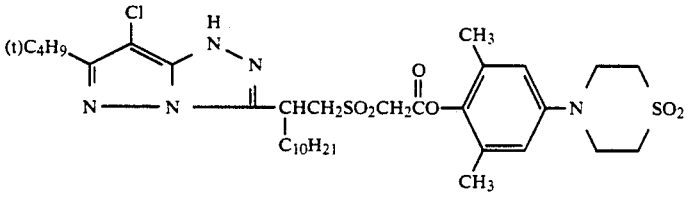
MA-80
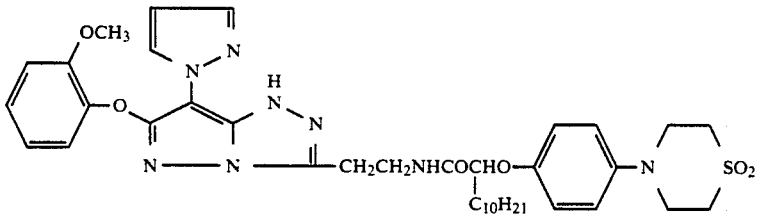
MA-81
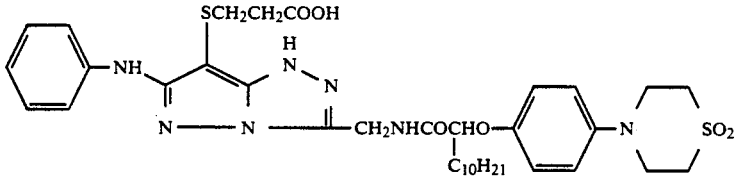
MA-82
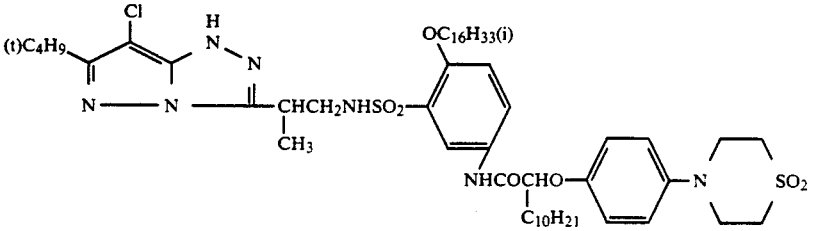

-continued
MA-83
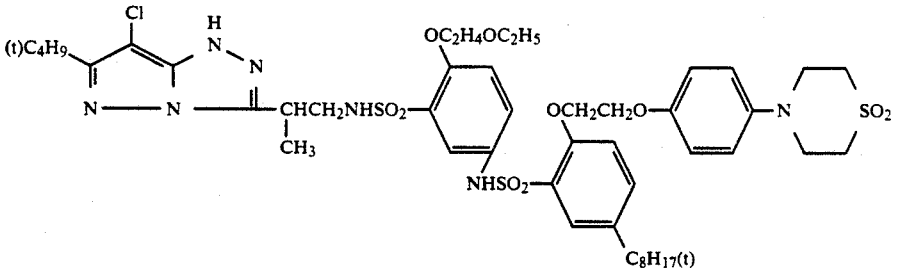
MA-84
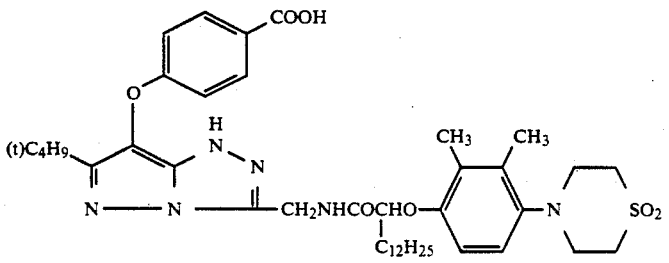
MA-85
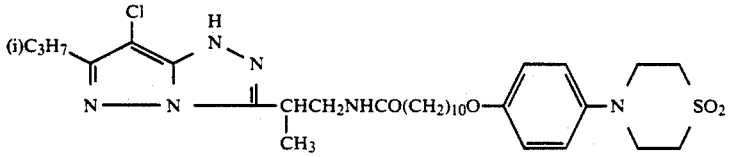
MA-86
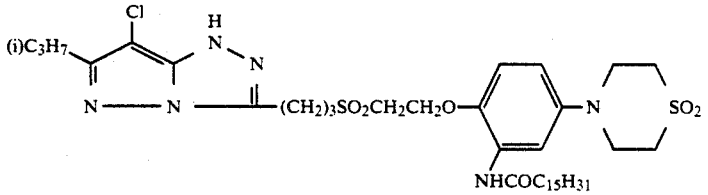
MA-87
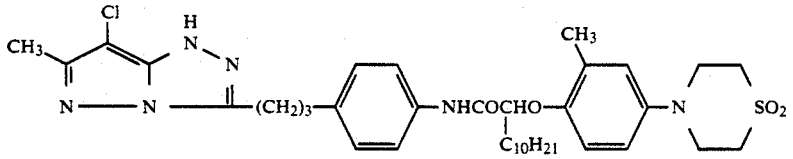
MA-88
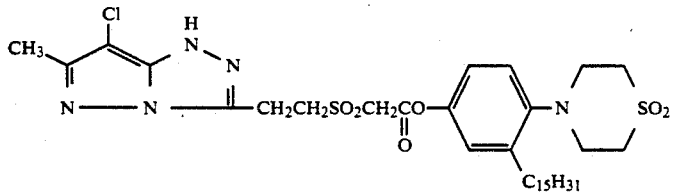
MA-89
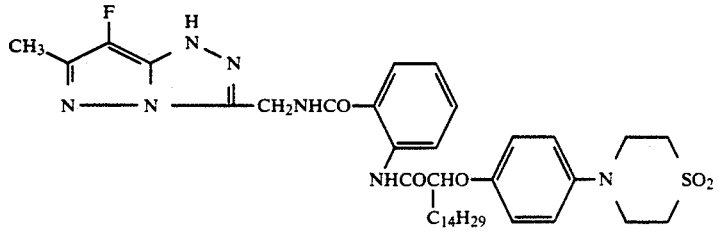

-continued
MA-90
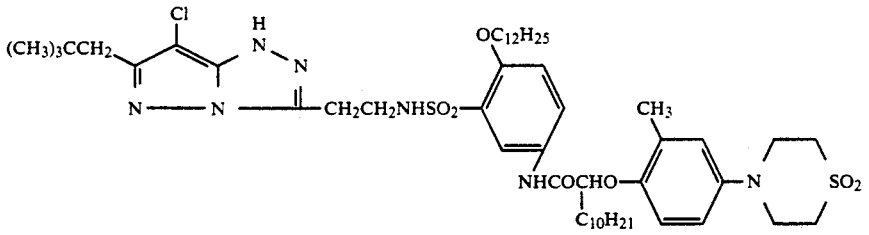
MA-91
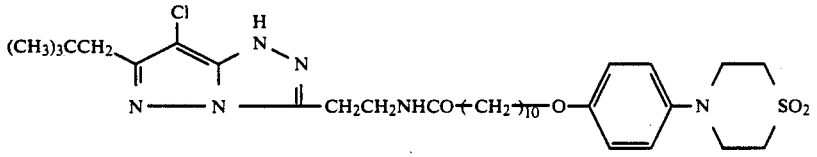
MA-92
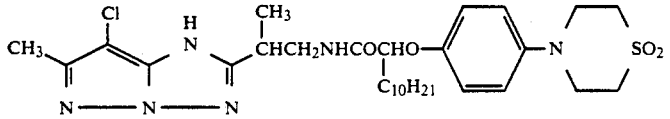
MA-93
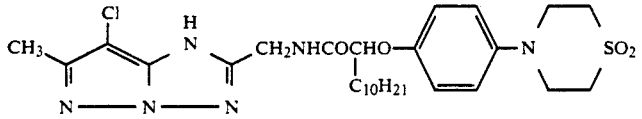
MA-94
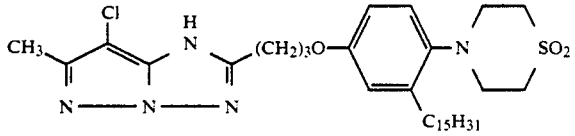
MA-95
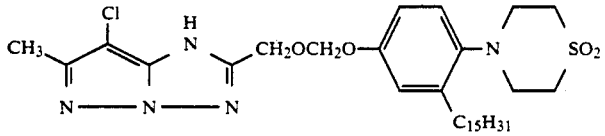
MA-96
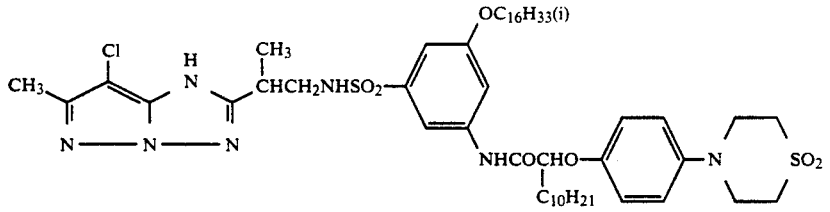
MA-97
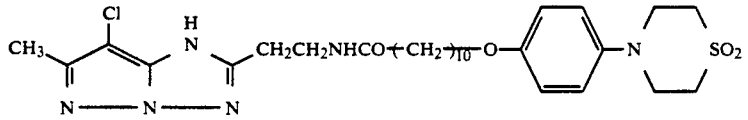
MA-98
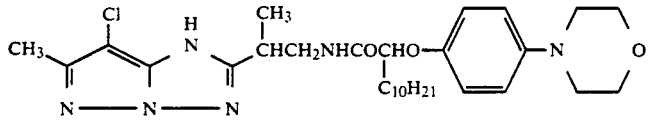

-continued
MA-99
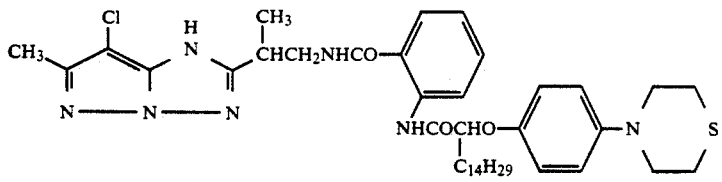
MA-100
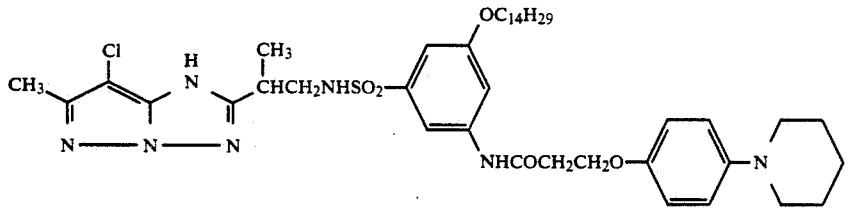
MA-101
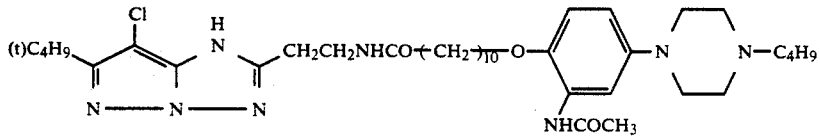
MA-102
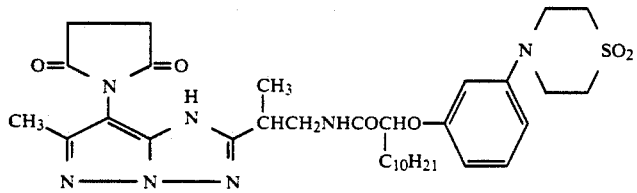
MA-103
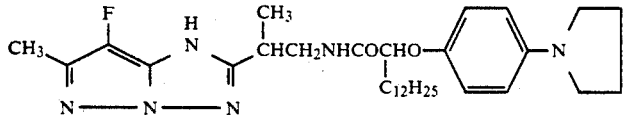
MA-104
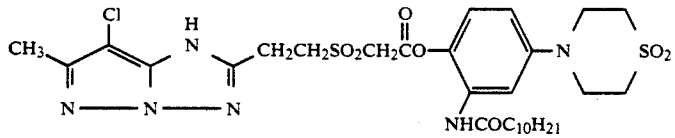
MA-105
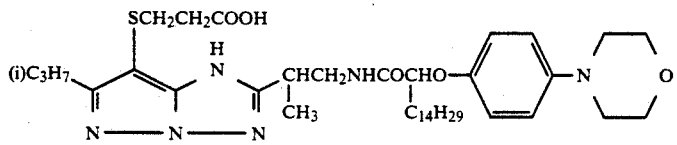
MA-106
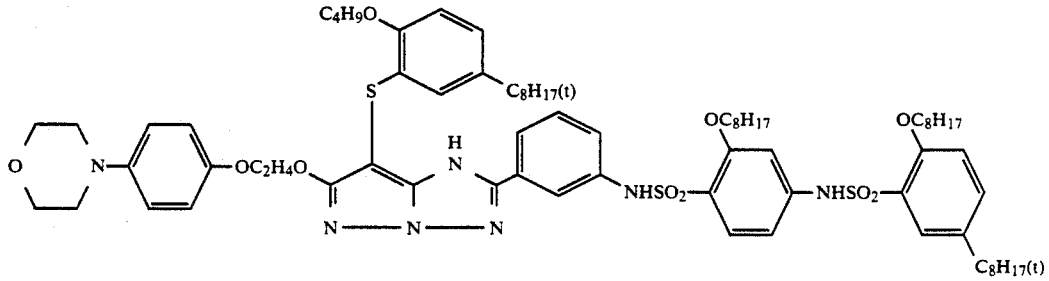

-continued

MA-107

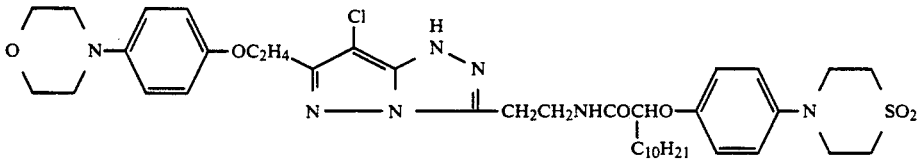

MA-108

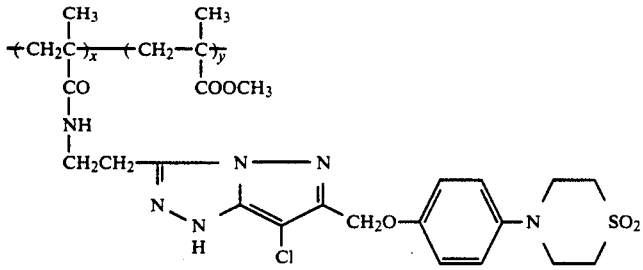

x:y = 40:60 (mol ratio)

MA-109

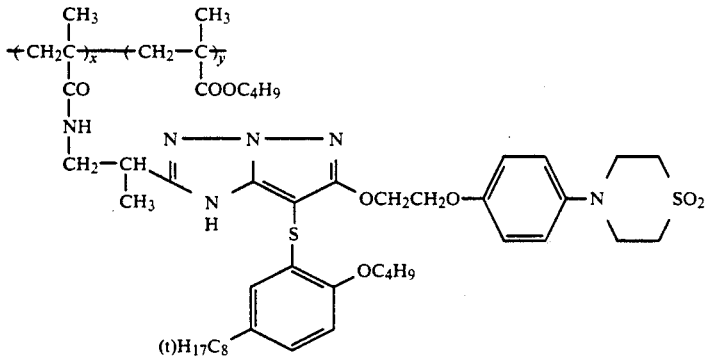

x:y = 50:50 (mol ratio)

The above-mentioned pyrazoloazole type magenta couplers relating to the invention can readily be synthesized by the skilled in the art with reference to 'Journal of the Chemical Society', Perkin I, 1977, pp.2047-2052; U.S. Pat. No. 3,725,067; JP OPI Publication Nos. 59-99437(1984), 58-42045(1983), 59-162548(1984), 59-171956(1984), 60-33552(1985), 60-43659(1985), 60-172982(1985), 60-190779(1985), 61-189439(1986), 61-241754(1986), 63-163351(1988) and 62-157031(1987).

The typical synthesizing examples of the above-mentioned pyrazoloazole type magenta couplers relating to the invention will now be given below.

SYNTHESIS EXAMPLE 1

<Synthesis of Exemplified Compound MA-1>

The synthesis procedures thereof will be given below.

Synthesis Procedures

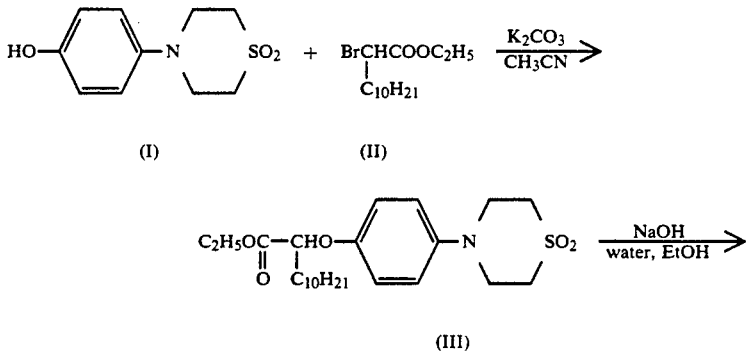

(I) (II) (III)

-continued

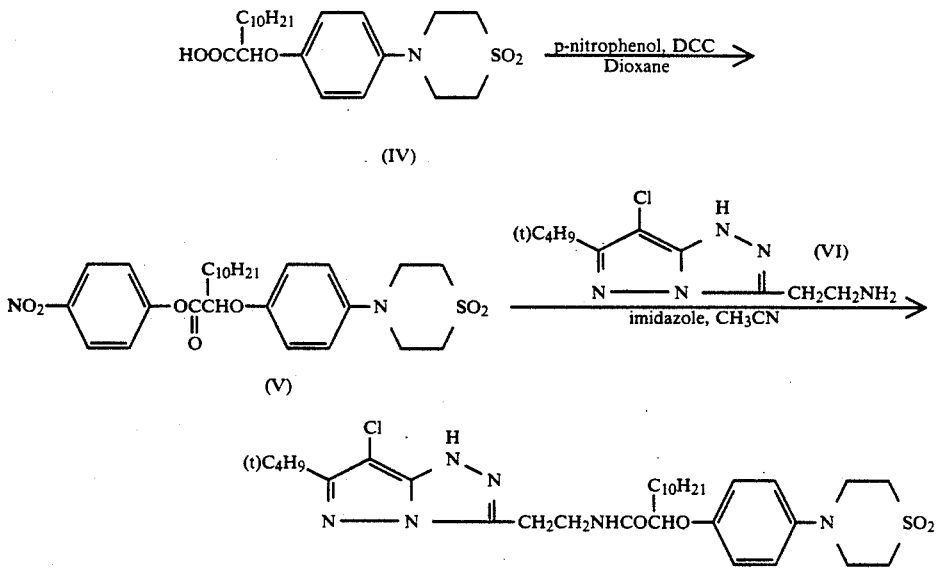

Exemplified Compound MA-1

Each of 10.0 g of Compound (I), 9.2 g of potassium carbonate and 17.6 g of ethyl α-bromolaurate (II) were added into 250 cc of acetonitrile and the mixture was reduced with heating for 10 hours. Then the deposited potassium bromide was filtrated with heating.

The resulting filtrate was distilled off under reduced pressure and the resulting residue was extracted with 200 cc of ethyl acetate. After the extract was washed, it was dried with magnesium sulfate anhydride and the ethyl acetate was then distilled off under reduced pressure. The resulting light yellow residue was recrystallized out of the acetonitrile, so that 15.2 g of Compound (III) could be prepared.

After dissolving 9.1 g of the resulting Compound (III) in 45 cc of ethyl alcohol, the resulting solution was added with a solution prepared by dissolving 1.6 g of sodium hydroxide in 50 cc of water and the resulting mixed solution was reduced with heating for 3 hours. After completing the reaction, the alkalinity thereof was neutralized with dilute hydrochloric acid and the ethyl alcohol was distilled off under reduced pressure. After an extraction was made with ethyl acetate and the extract was washed, the extract was then dried with magnesium sulfate anhydride and the ethyl acetate was distilled off under reduced pressure. The resulting oily matter was recrystallized out of 30 cc of acetonitrile, so that 7.2 g of white crystallized Compound (IV) could be prepared.

Next, each of 1.4 g of p-nitrophenol and 20 cc of dioxane were added to 4.3 g of the resulting Compound (IV) and dissolved together. The resulting mixed solution was added with 2.3 g of dicyclohexyl carbodiimide (DCC) and the mixture thereof was stirred at room temperature for 2 hours. After the resulting precipitation was filtrated and the solvent was distilled off under reduced pressure, 50 cc of ethyl acetate was further added thereto. The resulting solution was washed three times with 50 cc of an aqueous 5% sodium carbonate solution and dried with magnesium sulfate anhydride. After the solvent was distilled off under reduced pressure, 5.1 g of orange-colored oily Compound (V) could be prepared. Thereto, 60 cc of dimethyl acetamide and then 2.2 g of Compound (VI) were each added and dissolved together with heating. After then, 150 cc of acetonitrile and 0.5 g of imidazole were added thereto and reduced with heating for 4 hours. After the solvent, i.e., acetonitrile, was distilled off under reduced pressure, 300 cc of ethyl acetate and 200 cc of water were added and the resulting mixed solution was separated. Further, the resulting organic phase was washed three times with 100 cc of an aqueous 5% sodium carbonate solution and was then dried with sodium sulfate anhydride. After the solvent was distilled off under reduced pressure, the resulting matter was refined in silica-gel column chromatography, so that 5.0 g of white amorphous Exemplified Compound (MA-1) could be prepared.

(The structure thereof was confirmed by $^1$HNMR, FD mass-spectral analysis and IR spectral analysis.)

It is preferred to contain a magenta coupler applicable to the invention in a silver halide emulsion. The magenta coupler may be contained therein in a well-known method. For example, the magenta coupler relating to the invention can be contained in a silver halide emulsion in the following manner. The magenta coupler relating to the invention is dissolved in a high boiling organic solvent having a boiling point of not lower than 175° C. such as tricresyl phosphate and dibutyl phthalate or a low boiling solvent such as ethyl acetate and butyl propionate independently or, if required, in the mixture thereof independently or in combination, and the resulting solution is mixed with an aqueous gelatin solution containing a surfactant. After that, the resulting mixture is emulsified by making use of a high-speed rotary mixer or a colloid-mill and the emulsified mixture is then added into the silver halide emulsion.

The magenta coupler relating to the invention may usually be used in an amount within the range of $1\times10^{-3}$ to 1 mol and, preferably, $1\times10^{-2}$ to $8\times10^{-1}$ mols per mol of silver halide.

It is also allowed to use the magenta couplers relating to the invention with other kinds of magenta couplers in combination.

It is further allowed to use the magenta couplers relating to the invention with an image stabilizer represented by the following Formula [A] or [B] in combination.

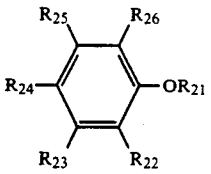

Formula [A]

wherein $R_{21}$ represents a hydrogen atom, an alkyl group, an alkenyl group, an aryl group or a heterocyclic group. Among them, the alkyl groups include, for example, the straight-chained or branched alkyl groups such as those of a methyl group, an ethyl group, a propyl group, an n-octyl group, a tert-octyl group, a benzyl group and a hexadecyl group.

The alkenyl groups represented by $R_{21}$ include, for example, an allyl group, a hexenyl group and an octenyl group.

The aryl groups represented by $R_{21}$ include, for example, a phenyl group and a naphthyl group.

The heterocyclic groups represented by $R_{21}$ include, typically, a tetrahydropyranyl group and a pyrimidyl group.

Each of the groups represented by $R_{21}$ include those having a substituent.

In Formula [A], $R_{22}$, $R_{23}$, $R_{25}$ and $R_{26}$ represent each a hydrogen atom, a halogen atom, a hydroxyl group, an alkyl group, an alkenyl group, an aryl group, an alkoxy group or an acylamino group. Among them, the alkyl, alkenyl and aryl groups include each the same alkyl, alkenyl and aryl groups described of $R_{21}$.

The above-mentioned halogen atoms include a fluorine atom, a chlorine atom and a bromine atom.

The above-mentioned alkoxy groups include, typically, a methoxy group, an ethoxy group and a benzyloxy group. Further, the acylamino group is represented by $R_{27}$—CONH— in which $R_{27}$ represents an alkyl group (such as a methyl, ethyl, n-propyl, n-butyl, n-octyl, tert-octyl or benzyl group), an alkenyl group (such as an allyl, octenyl or oleyl group), an aryl group (such as a phenyl, methoxyphenyl or naphthyl group) or a heterocyclic group (such as a pyridinyl or pyrimidyl group).

In the foregoing Formula [A], $R_{24}$ represents an alkyl group, a hydroxyl group, an aryl group, an alkoxy group, an alkenyloxy group or an aryloxy group. Among them, the alkyl and aryl groups include, typically, the same alkyl and aryl groups represented by the foregoing $R_{21}$. And, the alkoxy groups represented by $R_{24}$ include the same alkoxy groups described of the foregoing $R_{22}$, $R_{23}$, $R_{25}$ and $R_{26}$.

In addition, $R_{21}$ and $R_{22}$ may be closed in a ring so as to form a 5- or 6-membered heterocyclic ring, and $R_{23}$ and $R_{24}$ may be closed in a ring so as to form a 5-membered ring. These rings also include those spiro-bonded to other rings.

The typical examples of the compounds represented by the foregoing Formula [A] will now be given below. It is, however, to be understood that the invention shall not be limited thereto.

A-1

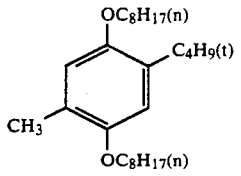

A-2

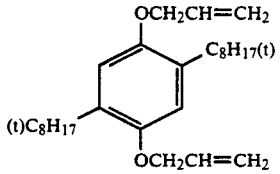

A-3

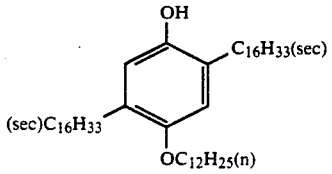

A-4

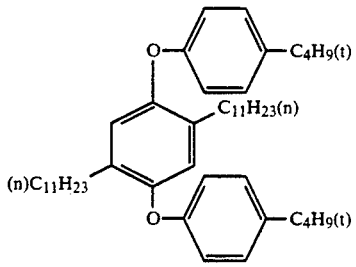

A-5

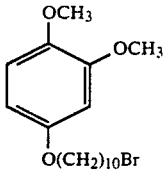

A-6

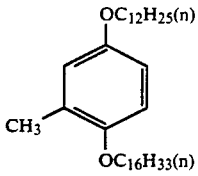

A-7

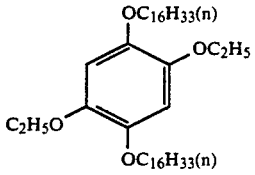

A-8

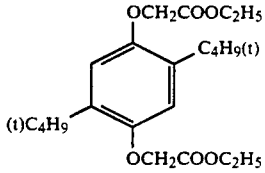

-continued

A-9

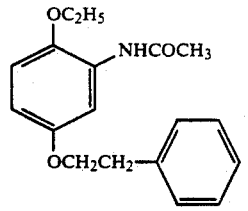

A-10

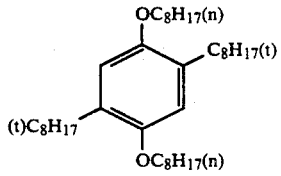

A-11

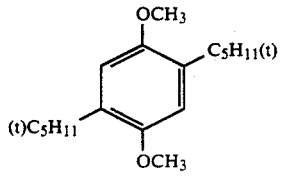

A-12

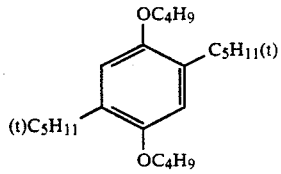

A-13

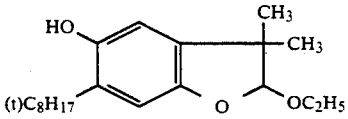

A-14

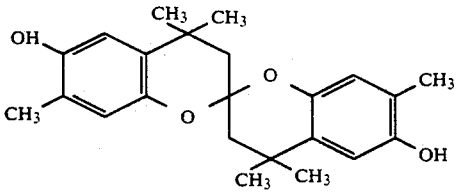

A-15

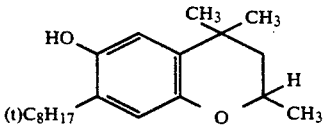

A-16

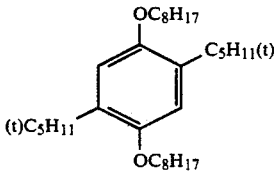

A-17

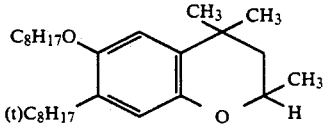

-continued

A-18

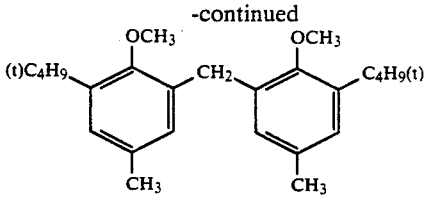

A-19

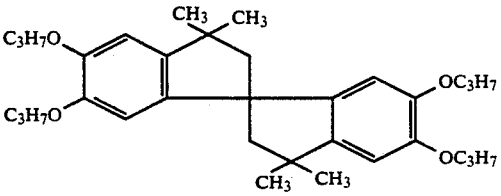

A-20

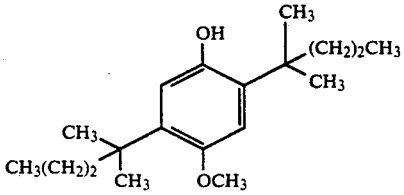

A-21

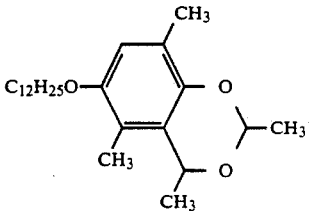

A-22

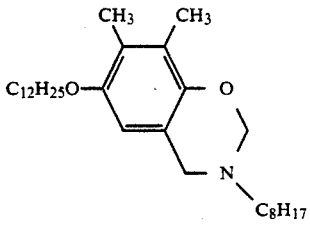

A-23

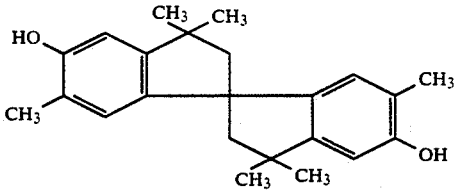

A-24

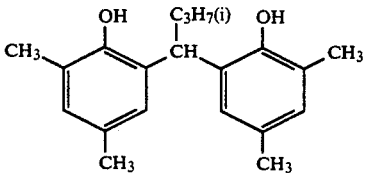

The compounds represented by Formula [A] can readily be synthesized in the procedures described in, for example, 'Journal of the Chemical Society', 1962, pp.415–417; ibid., 1965, pp.2904 to 2914; 'The Journal of Organic Chemistry', Vol.23, pp.75–76; 'Tetrahedron', Vol.26, 1970, pp.4743–4751; 'Chemical Letter', (4), 1972, pp.315–316; 'Bulletin of Chemical Society of Japan' No.10, 1972, pp.1987–1990; and 'Bulletin of Chemical Society of Japan', vol.53, 1980, pp.555–556.

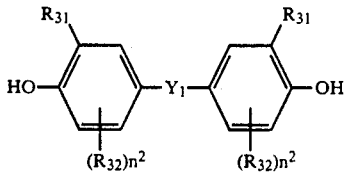

Formula [B]

wherein $R_{31}$ represents a secondary or tertiary alkyl group, a secondary or tertiary alkenyl group, a cycloalkyl group or an aryl group; $R_{32}$ represents a halogen atom, an alkyl group, an alkenyl group, a cycloalkyl group or an aryl group; and $n^2$ is an integer of 0 to 3; provided, when two or more each of $R_{31}$ and $R_{33}$ are made present, they may be the same with or the different from each other.

Y represents S, SO, $SO_2$ or an alkylene group.

The secondary or tertiary alkyl groups or the secondary or tertiary alkenyl groups each represented by $R_{31}$ include desirably, those having 3 to 32 carbon atoms and, preferably, those having 4 to 12 carbon atoms. They include, typically, a t-butyl, s-butyl, t-amyl, s-amyl, t-octyl, i-propyl, i-propenyl or 2-hexenyl group.

The alkyl groups represented by $R_{32}$ include, preferably, those having 1 to 32 carbon atoms. The alkenyl groups represented by $R_{32}$ include, preferably, those having 2 to 32 carbon atoms. These groups may be straight-chained or branched and they include, typically, a methyl, ethyl, t-butyl, pentadecyl, 1-hexanonyl, 2-chlorobutyl, benzyl, 2,4-di-t-amylphenoxymethyl, 1-ethoxytridecyl, allyl or isopropenyl group.

The cycloalkyl groups represented by $R_{31}$ and $R_{32}$ include, preferably, those having 3 to 12 carbon atoms. They include, typically, a cyclohexyl, 1-methylcyclohexyl or cyclopentyl group.

The aryl groups represented by $R_{31}$ and $R_{32}$ include, preferably, a phenyl group and a naphthyl group. They include, typically, a phenyl, 4-nitrophenyl, 4-t-butylphenyl, 2,4-di-t-amylphenyl, 3-hexadecyloxyphenyl or α-naphthyl group.

The alkylene groups represented by $Y_1$ include, preferably, those having 1 to 12 carbon atoms. They include, typically, a methylene, ethylene, propylene or hexamethylene group.

Each of the groups represented by the above-mentioned $R_{31}$, $R_{32}$ and $Y_1$ are each also allowed to have a substituent.

The substituents $R_{31}$, $R_{32}$ and $Y_1$ are each allowed to have include, for example, a halogen atom and a nitro, cyano, sulfonamido, alkoxy, aryloxy, alkylthio, arylthio or acyl group.

The typical examples of the compounds represented by Formula [B] will be given below. It is, however, to be understood that the invention shall not be limited thereto.

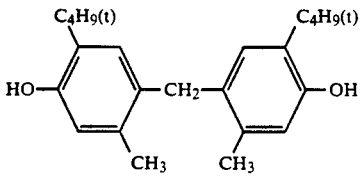

B-1

-continued

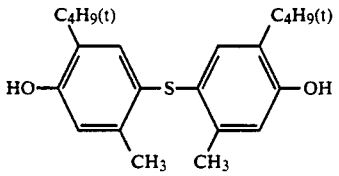

B-2

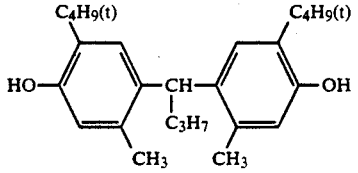

B-3

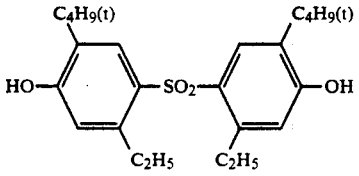

B-4

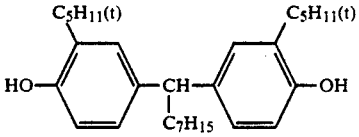

B-5

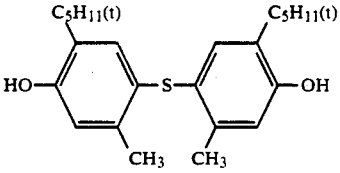

B-6

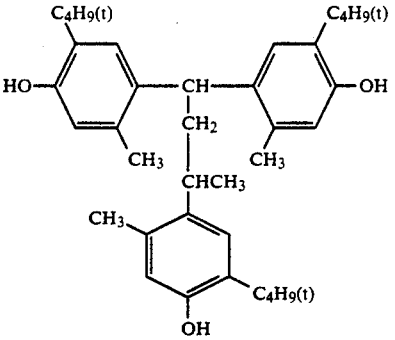

B-7

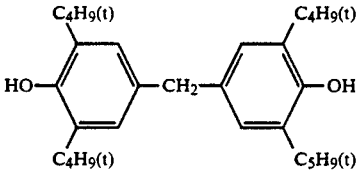

B-8

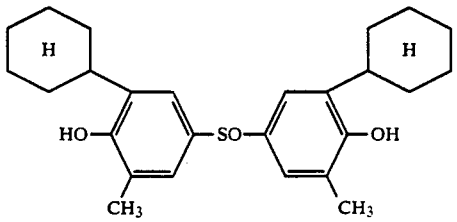

B-9

-continued

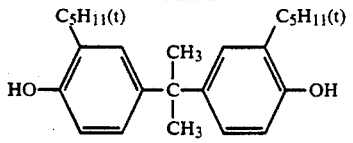

B-10

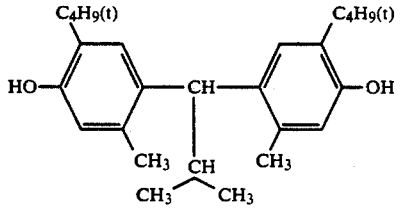

B-11

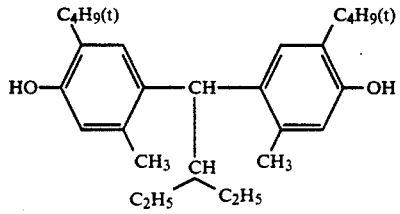

B-12

The compounds represented by Formula [B] can readily be synthesized in the procedures described in, for example, U.S. Pat. No. 2,807,653, 'Journal of the Chemical Society', Perkin I, 1979, p. 1712.

The image stabilizers represented by the foregoing Formulas [A] and [B] may be used in an amount within the range of, desirably, 5 to 400 mol % and, preferably, 10 to 250 mol % of the pyrazoloazole type magenta couplers relating to the invention.

It is desired that the pyrazoloazole type magenta couplers of the invention and the above-mentioned image stabilizers are used in one and the same layer. It is, however, allowed to use the image stabilizers in the layer adjacent to a layer containing the above-mentioned couplers.

The silver halides desirably used in the invention are comprised of silver chloride, silver chlorobromide or silver chloroiodobromide and, further, they may also be comprised of a combined mixture such as the mixture of silver chloride and silver bromide.

In the silver halide emulsions applicable to the invention, it is allowed to use any one of silver halides such as silver bromide, silver iodobromide, silver iodochloride, silver chlorobromide, silver chloroiodobromide and silver chloride, provided, they can be used in ordinary silver halide emulsions.

The silver halide grains may be either those having the uniform distribution of silver halide compositions inside the grains or those of the core/shell type having the different silver halide compositions between the inside of the grains and the surface layers of the grains.

The silver halide grains may be either those capable of forming a latent image mainly on the surfaces thereof or those capable of forming a latent image mainly inside the grains thereof.

The silver halide grains may be either those having a regular crystal form such as a cube, octahedron or tetradecahedron or those having an irregular crystal form such as a globular or tabular form. It is allowed to use the grains having any ratios of {100} planes to {111} planes.

These grains may also have a mixed crystal form or may be mixed with the grains having various crystal forms.

The silver halide grains applicable there to are to have a grain size within the range of, desirably, 0.05 to 30μ and, preferably, 0.1 to 20μ.

The silver halide emulsions having any grain size distributions may be used. It is, therefore, allowed to use either the emulsions having a wide grain size distribution (hereinafter referred to as 'polydisperse type emulsions') or the independent or mixed emulsions having a narrow grain size distribution (hereinafter referred to as 'monodisperse type emulsions'). It is, further, allowed to use the mixtures of the polydisperse type and monodisperse type emulsions. The couplers applicable to the invention include a colored coupler capable of displaying a color compensation effect and the compounds capable of releasing a photographically useful fragment such as a development retarder, a development accelerator, a bleach accelerator, a developing agent, a silver halide solvent, a color toner, a layer hardener, a foggant, an antifoggant, a chemical sensitizer, a spectral sensitizer and a desensitizer. Among these compounds, it is also allowed to use the so-called DIR compounds capable of releasing a development retarder in the course of carrying out a development and improving the sharpness and graininess of an image.

The above-mentioned DIR compounds include those containing a retarder directly coupled to the coupling position thereof and those containing a retarder coupled to the coupling position through a divalent group and capable of releasing the retarder either upon intramolecular nucleophilic reaction or upon intramolecular electron-transfer reaction, produced in a group split off upon coupling reaction, (the latter compounds are hereinafter referred to as 'timing DIR compounds'). The retarders applicable thereto include those becoming diffusible upon splitting off and those not having a diffusibility so much, independently or in combination so as to meet the purposes of application.

The above-mentioned couplers are to make a coupling reaction with the oxidized products of an aromatic primary amine developing agent and these couplers may also be used in combination with a colorless coupler not forming any dyes (hereinafter referred to as 'competing coupler') as a dye-forming coupler.

The yellow couplers preferably applicable to the invention include, for example, the well-known acylacetanilide type couplers. Among these couplers, benzoyl acetanilide type and pivaloyl acetanilide type compounds may advantageously be used.

The cyan couplers preferably applicable to the invention include, for example, phenol type and naphthol type couplers.

It is also allowed to use a color-fog inhibitor for the purposes of preventing a color stain, a sharpness deterioration and/or a rough graininess, which may be produced by transferring the oxidized products of an developing agent or an electron transferrer between the emulsion layers of a light sensitive material (i.e., between the same color-sensitive layers and/or between the different color-sensitive layers).

An image stabilizer capable of preventing the deterioration of a dye image may be applied to the light sensitive materials of the invention. The compounds preferably applicable thereto are described in, for example, RD 17643, Article VII-J.

For the purposes of preventing any fog from being produced by a electric discharge generated by frictionally static-charging a light sensitive material and preventing an image from being deteriorated by UV rays, a UV absorbent may also be contained in the hydrophilic colloidal layers thereof such as the protective layers and interlayers.

For the purpose of preventing a magenta-dye forming coupler from being deteriorated by formalin in the course of preserving a light sensitive material, a formalin scavenger may further be used in the light sensitive material.

The invention can preferably be applied to a color negative film, a color paper, a color reversal film and so forth.

Now, the invention will be detailed with reference to the following preferred embodiments. It is, however, to be understood that the embodiments of the invention shall not be limited thereto.

EXAMPLE 1

Sample 101 of multilayered silver halide color photographic light sensitive materials was prepared in the following manner. Over to a polyethylene-laminated paper support containing polyethylene on one side thereof and titanium oxide on the other side thereof, each of the layers having the compositions shown in the following Tables 1 and 2 were coated thereover on the side of the polyethylene layer containing titanium oxide.

| Layer | Composition | Amount added ($g/m^2$) |
|---|---|---|
| 7th layer (Protective layer) | Gelatin | 1.00 |
| 6th layer (UV abosorbing layer) | Gelatin | 0.40 |
| | UV absorbent (UV-1) | 0.10 |
| | UV absorbent (UV-2) | 0.04 |
| | UV absorbent (UV-3) | 0.16 |
| | Antistaining agent (HQ-1) | 0.01 |
| | DNP | 0.20 |
| | PVP | 0.03 |
| | Anti-irradiation dye (AIC-1) | 0.02 |
| 5th layer (Res-sensitive layer) | Gelatin | 1.30 |
| | Red-sensitive silver chlorobromide emulsion (Em-R) | 0.21 |
| | Cyan coupler (EC-1) | 0.24 |
| | Cyan coupler (EC-2) | 0.08 |
| | Dye-image stabilizer (ST-1) | 0.20 |
| | Antistaining agent (HQ-1) | 0.01 |
| | HBS-1 | 0.20 |
| | DOP | 0.20 |
| 4th layer (UV absorbing layer) | Gelatin | 0.94 |
| | UV absorbent (UV-1) | 0.28 |
| | UV absorbent (UV-2 | 0.09 |
| | UV absorbent (UV-3) | 0.38 |
| | Antistaining agent (HQ-1) | 0.03 |
| | DNP | 0.40 |
| 3rd layer | Gelatin | 1.40 |

-continued

| Layer | Composition | Amount added ($g/m^2$) |
|---|---|---|
| (Green-sensitive layer) Magenta coupler (EM-1) | Green-sensitive silver chlorobromide emulsion (Em-G) 0.75* | 0.17 |
| | DNP | 0.20 |
| | Dye-image stabilizer (ST-3) | 0.75* |
| | Anti-irradiation dye (AIM-1) | 0.01 |
| 2nd layer (Interlayer) | Gelatin | 1.20 |
| | Antistaining agent (HQ-2) | 0.03 |
| | Antistaining agent (HQ-3) | 0.03 |
| | Antistaining agent (HQ-4) | 0.05 |
| | Antistaining agent (HQ-5) | 0.23 |
| | DIDP | 0.06 |
| | Antimold (F-1) | 0.002 |
| 1st layer (Blue-sensitive layer) | Gelatin | 1.20 |
| | Blue-sensitive silver chlorobromide emulsion (Em-B) | 0.26 |
| | Yellow coupler (EY-1) | 0.80 |
| | Dye-image stabilizer (ST-1) | 0.30 |
| | Dye-image stabilizer (ST-2) | 0.20 |
| | Antistaining agent (HQ-1) | 0.02 |
| | Anti-irradiation dye (AIY-1) | 0.01 |
| | DNP | 0.20 |
| Support | Polyethylene-laminated paper sheet | |

*milli-mol/$m^2$

Amounts of the silver halide emulsions added were each shown in terms of the silver contents.

The coating solutions were each prepared in the following manner.

Coating Solution for the 1st Layer

Ethyl acetate of 60 cc was added and dissolved into 26.7 g of yellow coupler (EY-1), 10.0 g of dye-image stabilizer (ST-1), 6.67 g of a dye-image stabilizer (ST-2), 0.67 g of antistaining agent (HQ-1) and 6.67 g of high-boiling organic solvent (DNP). The resulting solution was emulsified and dispersed in 220 cc of an aqueous 10% gelatin solution containing 7 cc of an aqueous 20% surfactant (SU-2) solution by making use of a supersonic homogenizer, so that a yellow coupler dispersed solution could be prepared.

The resulting dispersed solution was mixed with the following blue-sensitive silver halide emulsion (containing 8.67 g of silver) and antiirradiation dye (AIY-1) was further added thereto, so that the coating solution for the 1st layer could be prepared.

The coating solutions for the 2nd through 7th layers were also prepared in the same manner as in the above-mentioned coating solution for the 1st layer. Besides, for the layer hardeners, (HH-1) were each added to the 2nd and 4th layers and (HH-2) to the 7th layer, respectively. For the coating aids, surfactants (SU-1) and (SU-3) were each added thereto so that the surface tension of each layer could be controlled.

The chemical structures of the compounds applied to each of the above-mentioned layers were as follows.

EY-1

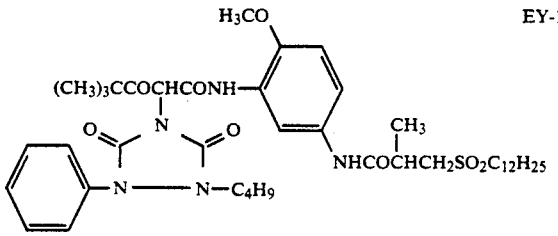

EC-1

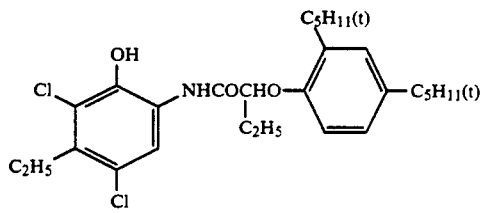

-continued
EC-2
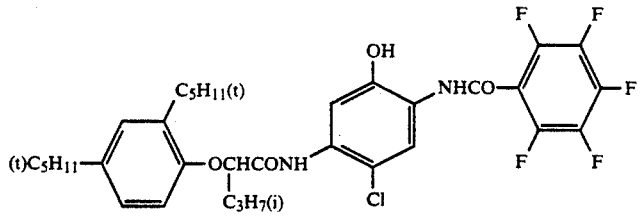
ST-1
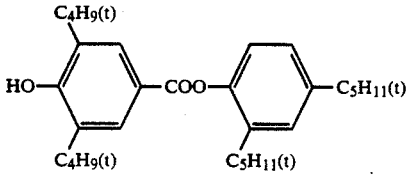
ST-2
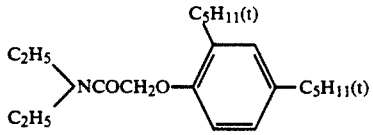
ST-3
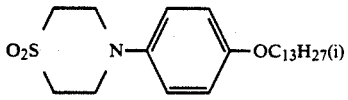
EM-1
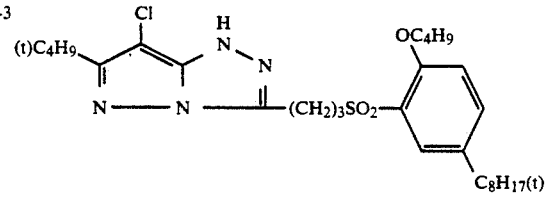
EM-2
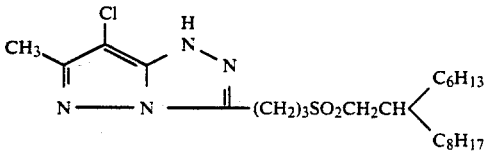
EM-3
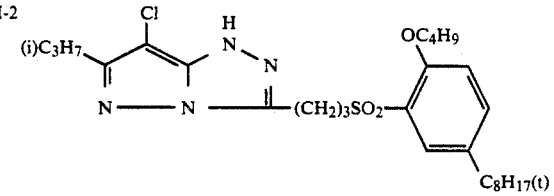
EM-4
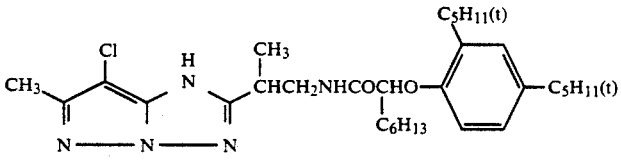
UV-1
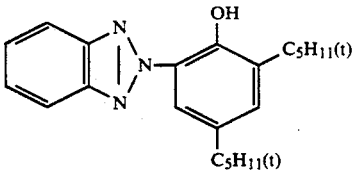
UV-2
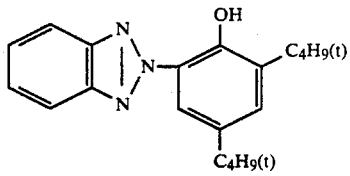
UV-3
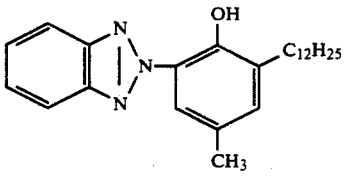
DOP = Dioctyl phthalate
DNP = Dinonyl phthalate
DIDP = Diisodecyl phthalate
PVP = Polyvinyl pyrrolidone
HQ-1
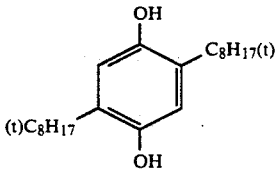
HQ-2
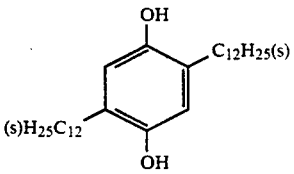

-continued

HQ-3

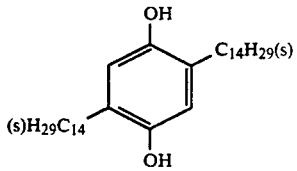

HQ-4

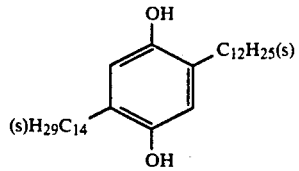

HQ-5

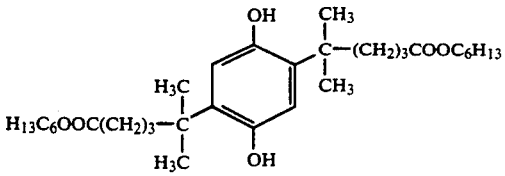

HBS-1

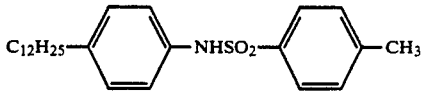

AIM-1

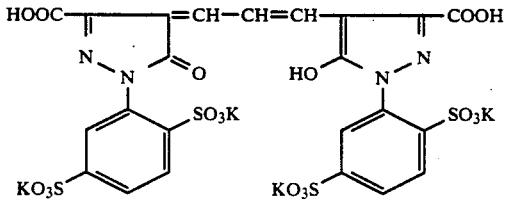

AIC-1

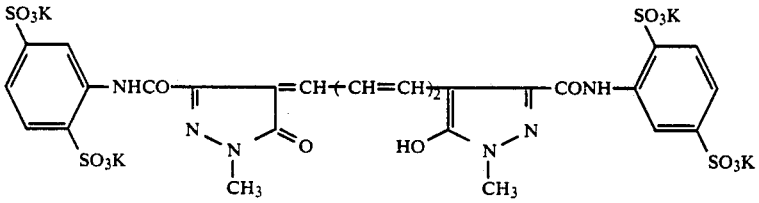

AIY-1

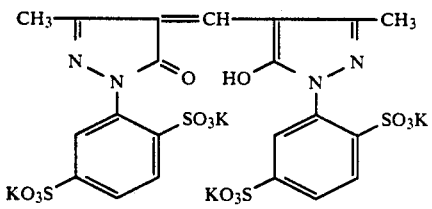

SU-1

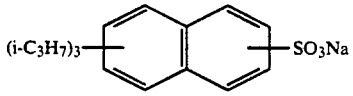

SU-2

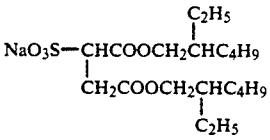

SU-3

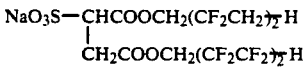

HH-1

$C(CH_2SO_2CH{=}CH_2)_4$

HH-2

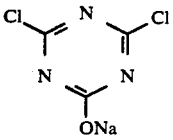

F-1

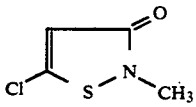

Blue-Sensitive Silver Halide Emulsion (Em-B)

This was a monodisperse type cubic silver chlorobromide emulsion having an average grain size of 0.85 μm, a variation coefficient of 0.07 and a silver chloride content of 99.5 mol %.

| | |
|---|---|
| Sodium thiosulfate | 0.8 mg/mol of AgX |

-continued

| | |
|---|---|
| Chloroauric acid | 0.5 mg/mol of AgX |
| Stabilizer STAB-1 | $6 \times 10^{-4}$ mols/mol of AgX |
| Sensitizing dye BS-1 | $4 \times 10^{-4}$ mols/mol of AgX |
| Sensitizing dye BS-2 | $1 \times 10^{-4}$ mols/mol of AgX |

Green-Sensitive Silver Halide Emulsion (Em-G)

This was a monodisperse type cubic silver chlorobromide emulsion having an average grain size of 0.43 μm, a variation coefficient of 0.08 and a silver chloride content of 99.5 mol %.

| | |
|---|---|
| Sodium thiosulfate | 1.5 mg/mol of AgX |
| Chloroauric acid | 1.0 mg/mol of AgX |
| Stabilizer STAB-1 | $6 \times 10^{-4}$ mols/mol of AgX |
| Sensitizing dye GS-1 | $4 \times 10^{-4}$ mols/mol of AgX |

Red-Sensitive Silver Halide Emulsion (Em-R)

This was a monodisperse type cubic silver chlorobromide emulsion having an average grain size of 0.50 μm, a variation coefficient of 0.08 and a silver chloride content of 99.5 mol %.

| | |
|---|---|
| Sodium thiosulfate | 1.8 mg/mol of AgX |
| Chloroauric acid | 2.0 mg/mol of AgX |
| Stabilizer STAB-1 | $6 \times 10^{-4}$ mols/mol of AgX |
| Sensitizing dye RS-1 | $1 \times 10^{-4}$ mols/mol of AgX |

The chemical structures of the compounds applied to each of the monodiserse type cubic emulsions were as follows.

Next, Samples 102 through 130 were each prepared in the same manner as in Sample 101, except that the coupler EM-1 of the 3rd layer was replaced by the same mols of the coupler of the invention shown in the following Table-3 and the dye-image stabilizer was replaced by those shown in Table-3, respectively.

The chemical structures of the magenta couplers EM-2, EM-3 and EM-4 each applied to the comparative samples are shown together with the chemical structure of the foregoing EM-1.

The resulting samples were each exposed to green light through a wedge in an ordinary procedures and they were then processed in the following processing steps.

| Processing step | Temperature | Time |
|---|---|---|
| Color developing | 35.0 ± 0.3° C. | 45 sec |
| Bleach-fixing | 35.0 ± 0.5° C. | 45 sec |
| Stabilizing | 30 to 34° C. | 90 sec |
| Drying | 60 to 80° C. | 60 sec |

The compositions of each of the processing solution will be given below.

The processing solutions were each replenished in an amount of 80 cc per $m^2$ of a subject silver halide color photographic light sensitive material.

BS-1

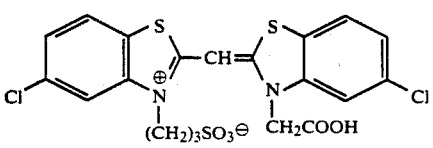

BS-2

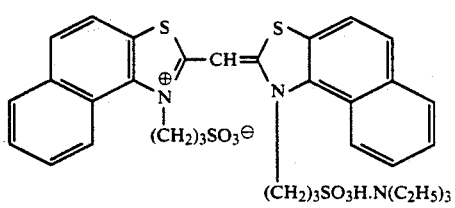

GS-1

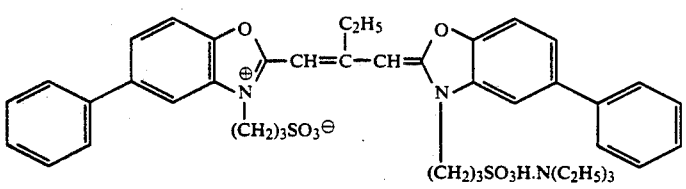

RS-1

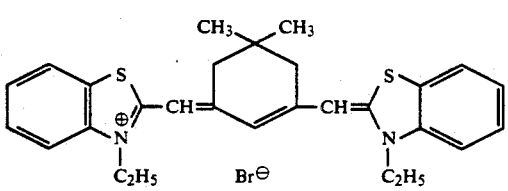

STAB-1

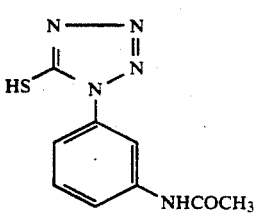

| Color developer | Tank solution | Replenishing solution |
|---|---|---|
| Pure water | 800 cc | 800 cc |
| Triethanol amine | 10 g | 18 g |
| N,N-diethyl hydroxyl amine | 5 g | 9 g |
| Potassium chloride | 2.4 g | |
| 1hydroxyethylidene-1,1-diphosphoric acid | 1.0 g | 1.8 g |
| N-ethyl-N-β-methanesulfonamidoethyl-3-methyl-4-aminoaniline sulfate | 5.4 g | 8.2 g |
| Fluorescent whitening agent, (a 4,4'-diaminostilbene sulfonic acid derivative) | 1.0 g | 1.8 g |
| Potassium carbonate | 27 g | 27 g |

Add water to make in total of 1000 cc

Adjust pH values of the tank solution to be 10.0 and of the replenisher to be 10.60, respectively.

| Bleach-fixer (The same in both of the tank solution and the replenishing solution) | |
|---|---|
| Ferric ammonium ethylenediamine tetraacetate, dihydrate | 60 g |
| Ethylenediaminetetraacetic acid | 3 g |
| Ammonium thiosulfate (in an aqueous 70% solution) | 100 cc |
| Ammonium sulfite (in an aqueous 40% solution | 27.5 cc |
| Add water to make in total of | 1000 cc |
| Adjust pH with potassium carbonate or glacial acetic acid to be | pH 5.7 |
| **Stabilizer (The same in both of the tank solution and the replenisher)** | |
| 5-chloro-2-methyl-4-isothiazoline-3-one | 1.0 g |
| Ethylene glycol | 1.0 g |
| 1-hydroxyethylidene-1,1-diphosphonic acid | 2.0 g |
| Ethylenediaminetetraacetic acid | 1.0 g |
| Ammonium hydroxide (in an aqueous 20% solution) | 3.0 g |
| Fluorescent whitening agent (a 4,4'-diaminostilbene sulfonic acid derivative) | 1.5 g |
| Add water to make in total of | 1000 cc |
| Adjust pH with sulfuric acid or potassium hydroxide to be | pH 7.0 |

The following evaluation were each carried out by making use of the samples which were continuously processed.

<Dmax>

The maximum color densities thereof were measured.

<Light-fastness>

The resulting samples were each exposed to a Xenon fade-o-meter for 7 days and the dye image residual percentage (%) thereof at the initial density of 1.0 were found out.

The results thereof are shown in Table 3.

TABLE 3

| Sample No. | Magenta coupler | Dye-image stabilizer | Dmax | Light-fastness (residual %) | Remarks |
|---|---|---|---|---|---|
| 101 | EM-1 | ST-3(1)* | 1.94 | 78 | Comp. |
| 102 | EM-1 | — | 1.92 | 32 | Comp. |
| 103 | MA-71 | — | 2.02 | 82 | Inv |
| 104 | MA-72 | — | 1.96 | 83 | Inv. |
| 105 | MA-1 | — | 2.45 | 86 | Inv. |
| 106 | MA-2 | — | 2.52 | 87 | Inv. |
| 107 | MA-73 | — | 1.98 | 81 | Inv. |
| 108 | MA-74 | — | 2.05 | 82 | Inv. |
| 109 | MA-10 | — | 2.11 | 83 | Inv. |

TABLE 3-continued

| Sample No. | Magenta coupler | Dye-image stabilizer | Dmax | Light-fastness (residual %) | Remarks |
|---|---|---|---|---|---|
| 110 | MA-4 | — | 2.08 | 84 | Inv. |
| 111 | MA-11 | — | 1.95 | 84 | Inv. |
| 112 | MA-12 | — | 2.05 | 86 | Inv. |
| 113 | EM-2 | ST-3(1)* | 2.45 | 36 | Comp. |
| 114 | EM-2 | — | 2.45 | 4 | Comp. |
| 115 | MA-87 | — | 2.51 | 62 | Inv. |
| 116 | MA-32 | — | 2.55 | 68 | Inv. |
| 117 | MA-30 | — | 2.60 | 70 | Inv. |
| 118 | MA-29 | — | 2.63 | 72 | Inv. |
| 119 | MA-36 | — | 2.61 | 79 | Inv. |
| 120 | EM-3 | ST-3(1)* | 2.20 | 46 | Comp. |
| 121 | EM-3 | — | 2.21 | 18 | Comp. |
| 122 | MA-85 | — | 2.25 | 74 | Inv. |
| 123 | MA-23 | — | 2.22 | 76 | Inv. |
| 124 | MA-22 | — | 2.25 | 79 | Inv. |
| 125 | MA-27 | — | 2.30 | 78 | Inv. |
| 126 | EM-4 | ST-3(1)* | 1.75 | 70 | Comp. |
| 127 | EM-4 | — | 1.70 | 16 | Comp. |
| 128 | MA-101 | — | 1.80 | 78 | Inv. |
| 129 | MA-98 | — | 1.82 | 80 | Inv. |
| 130 | MA-93 | — | 1.80 | 82 | Inv. |

*The values enclosed in the parentheses in the column of the dye-image stabilizers indicate the mol ratios thereof to the magenta couplers used.

In Samples No.101 through No.112 each shown in Table 3, the couplers thereof have each a t-butyl group as the substituents at the 6th position. In Samples No. 113 through No. 119, the couplers thereof have each a methyl group as the substituents at the 6th position. In Samples No. 120 through No. 125, the couplers thereof have each an isopropyl group as the substituents at the 6th position. And, in Samples No. 126 through No. 130, the couplers are each an H-pyrazolo[1,5-b]triazole type group. As compared to each other couplers by the types thereof, it was proved apparently in either cases that they were remarkably improved in light-fastness as compared to the comparative samples.

When comparing Samples No. 102 through No. 106 to Samples No. 107 through No. 112, it was proved that the light-fastness could be improved as the linking groups each linking the pyrazolotriazole mother nuclei to the amine type image stabilizers were getting shortened. The same facts were also proved in Samples No. 122 through No. 125 and No. 128 through No. 130 as well, so that it can be suggested that the physical distance between the mother nuclei of the couplers and the image stabilizers may be influenced on the light-fastness.

In either cases, it was also confirmed that the couplers of the invention have the color developabilities equivalent to or more excellent than those of the comparative samples.

EXAMPLE 2

Samples No. 201 through No. 231 were each prepared in the same manner as in Sample No. 101 of Example 1, except that the dye-image stabilizer used in the 3rd layer of Example 1 was replaced by the combination of those shown in the following Table 4.

The same evaluation as in Example 1 were each carried out by making use of the resulting samples; provided, the light-fastness thereof were evaluated on the dye-image residual percentages obtained after the samples were each exposed to a Xenon fade-o-meter for 12 days. The results thereof are shown in Table 4.

TABLE 4

| Sample No. | Magenta coupler | Dye-image stabilizer | Dmax | Light-fastness (residual %) | Remarks |
|---|---|---|---|---|---|
| 201 | EM-1 | ST-3(1)* + B-3(1)* | 1.96 | 71 | Comp. |
| 202 | MA-78 | B-3(1)* | 2.30 | 80 | Inv. |
| 203 | MA-76 | B-3(1)* | 2.19 | 81 | Inv. |
| 204 | MA-21 | B-3(1)* | 2.15 | 84 | Inv. |
| 205 | MA-1 | B-3(1)* | 2.40 | 86 | Inv. |
| 206 | MA-2 | B-3(1)* | 2.44 | 88 | Inv. |
| 207 | MA-44 | B-3(1)* | 2.21 | 85 | Inv. |
| 208 | MA-47 | B-3(1)* | 2.00 | 82 | Inv. |
| 209 | MA-51 | B-3(1)* | 1.98 | 83 | Inv. |
| 210 | EM-2 | ST-3(1)* + B-3(1)* | 2.49 | 31 | Comp. |
| 211 | MA-89 | B-3(1)* | 2.20 | 64 | Inv. |
| 212 | MA-33 | B-3(1)* | 2.50 | 68 | Inv. |
| 213 | MA-34 | B-3(1)* | 2.64 | 68 | Inv. |
| 214 | MA-35 | B-3(1)* | 2.52 | 70 | Inv. |
| 215 | MA-37 | B-3(1)* | 2.52 | 74 | Inv. |
| 216 | EM-3 | ST-3(1)* + B-3(1)* | 2.20 | 42 | Comp. |
| 217 | MA-86 | B-3(1)* | 2.25 | 67 | Inv. |
| 218 | MA-26 | B-3(1)* | 2.34 | 71 | Inv. |
| 219 | MA-24 | B-3(1)* | 2.48 | 74 | Inv. |
| 220 | EM-4 | ST-3(1)* + B-3(1)* | 1.77 | 67 | Comp. |
| 221 | MA-97 | B-3(1)* | 1.82 | 79 | Inv. |
| 222 | MA-92 | B-3(1)* | 1.99 | 82 | Inv. |
| 223 | EM-1 | ST-3(1)* + A-23(1)* | 1.94 | 74 | Comp. |
| 224 | MA-6 | A-23(1)* | 2.31 | 89 | Inv. |
| 225 | MA-2 | A-23(1)* | 2.40 | 90 | Inv. |
| 226 | EM-2 | ST-3(1)* + A-23(1)* | 2.43 | 33 | Comp. |
| 227 | MA-29 | A-23(1)* | 2.51 | 74 | Inv. |
| 228 | EM-3 | ST-3(1)* + A-23(1)* | 2.18 | 45 | Comp. |
| 229 | MA-23 | A-23(1)* | 2.17 | 78 | Inv. |
| 230 | EM-4 | ST-3(1)* + A-23(1)* | 1.67 | 71 | Comp. |
| 231 | MA-92 | A-23(1)* | 1.70 | 84 | Inv. |

*The values enclosed in the parentheses in the column of the dye-image stabilizers indicate the mol ratios thereof to the magenta couplers used.

It was proved from the contents of Table 4 that, even in every case where the phenol type dye-image stabilizers (B-3 and A-23) were used in combination, approximately the same inclination as in Example 1 was confirmed in all the types (i.e., the 6th positioned t-butyl, the 5th positioned methyl, the 6th positioned isopropyl and the 1H-pyrazolo[1.5-b]triazole types) and, further, the light-fastness thereof could remarkably be improved. In addition, the color developability equivalent to or more excellent that those of the comparative samples could also be obtained.

I claim:

1. A silver halide color photographic light sensitive material containing a magenta coupler represented by the following Formula I:

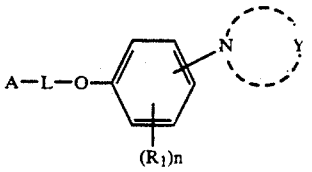

Formula I wherein A represents a residual group eliminating $R_2$ or $R_3$ from a pyrazolotriazole magenta coupler represented by the following Formula II or III; L represents a divalent linking group; Y represents a group consisting of the non-metal atoms necessary to form a 5- or 6-membered heterocyclic ring together with a nitrogen atom; $R_1$ represents a substituent; and n is an integer of 0 to 4:

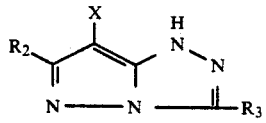

Formula II

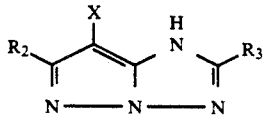

Formula III wherein $R_2$ and $R_3$ represent each a hydrogen atom or a substituent; and X represents a hydrogen atom or a group capable of splitting off upon reaction with the oxidized product of a color developing agent.

2. The silver halide color photographic light sensitive material as claimed in claim 1, wherein the magenta couplers represented by Formula I as given in claim 1 are each represented by the following Formula I-1 or I-2:

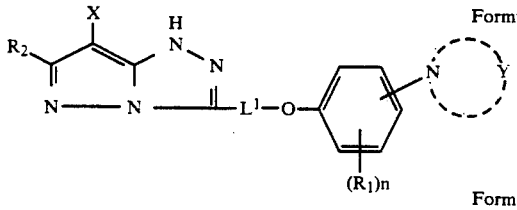

Formula I-1

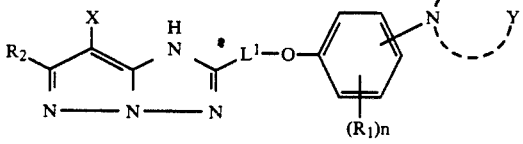

Formula I-2 wherein $L^1$ represents a divalent linking group having a principal chain length of not more than 5 atoms; $R_1$ and $R_2$ represent each a substituent; Y represents a group consisting of non-metal atoms necessary to form a 5- or 6-membered heterocyclic ring together with a nitrogen atom; n is an integer of 0 to 4; and X represents a hydrogen atom or a group capable of splitting off upon reaction with the oxidized product of a color developing agent.

3. The silver halide color photographic light sensitive material as claimed in claim 1, wherein the magenta couplers represented by Formula I as given in claim 1 are each represented by the following Formula I-3 or I-4:

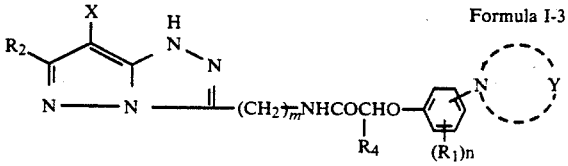

Formula I-3

-continued

Formula I-4

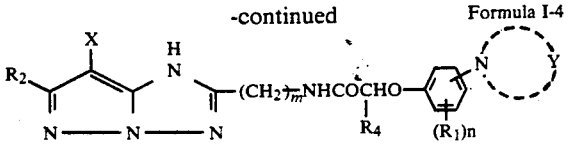

wherein $R_1$, $R_2$ and $R_4$ represent each a substituent; Y represents a group consisting of non-metal atoms necessary to form a 5- or 6-membered heterocyclic ring together with a nitrogen atom; n is an integer of 0 to 4; m is an integer of 1 or 2; and X represents a hydrogen atom or a group capable of splitting off upon reaction with the oxidized product of a color developing agent.

* * * * *